US011373476B1

(12) United States Patent
Crandall et al.

(10) Patent No.: US 11,373,476 B1
(45) Date of Patent: Jun. 28, 2022

(54) SYSTEMS AND METHODS FOR CASH-TILL OPTIMIZATION

(71) Applicant: G4S Retail Solutions (USA) Inc., Jupiter, FL (US)

(72) Inventors: Shellie Crandall, Jupiter, FL (US); Brian McCabe, Jupiter, FL (US)

(73) Assignee: G4S Retail Solutions (USA) Inc., Jupiter, FL (US)

( * ) Notice: Subject to any disclaimer, the term of this patent is extended or adjusted under 35 U.S.C. 154(b) by 52 days.

(21) Appl. No.: 16/906,056

(22) Filed: Jun. 19, 2020

Related U.S. Application Data

(60) Provisional application No. 62/863,382, filed on Jun. 19, 2019.

(51) Int. Cl.

| | |
|---|---|
| ***G07D 11/34*** | (2019.01) |
| ***G07D 11/30*** | (2019.01) |
| ***G07D 11/245*** | (2019.01) |
| ***G07D 11/23*** | (2019.01) |

(52) U.S. Cl.
CPC ..... *G07D 11/34* (2019.01); *G07D 11/23* (2019.01); *G07D 11/245* (2019.01); *G07D 11/30* (2019.01)

(58) Field of Classification Search
CPC ..... G07D 11/009; G07D 11/0096; G07D 11/125; G07D 11/23; G07D 11/245; G07D 11/30; G07D 11/32; G07D 11/34; G07D 11/50; G07D 11/00; G07D 11/0087; G07D 11/12; G07D 11/13; G07D 11/20; G07D 11/235; G07D 11/24; G07D 11/25; G07D 11/36; G07G 1/00; G07G 1/009; G07G 1/12; G07G 1/14; G06Q 20/20; G06Q 20/202
See application file for complete search history.

(56) References Cited

U.S. PATENT DOCUMENTS

| | | | |
|---|---|---|---|
| 7,610,215 | B1 | 10/2009 | Folk et al. |
| 7,635,085 | B2 | 12/2009 | Brown et al. |
| 7,900,829 | B1 | 3/2011 | Folk et al. |
| 7,940,176 | B2 | 5/2011 | Bohen et al. |
| 7,950,512 | B2 | 5/2011 | Folk et al. |
| 7,954,699 | B1 | 6/2011 | Sanders et al. |

(Continued)

OTHER PUBLICATIONS

United States Patent and Trademark Office, NonFinal Office Action for U.S. Appl. No. 16/516,026, dated Jul. 9, 2020, (9 pages), U.S.

(Continued)

*Primary Examiner* — Thien M Le
*Assistant Examiner* — April A Taylor
(74) *Attorney, Agent, or Firm* — Alston & Bird LLP

(57) ABSTRACT

To enable customer-facing transactions between merchants and customers that utilize cash designated as bank-owned cash (BOC), a monitoring server monitors quantities of cash within point-of-sale (POS) terminals, such as self-checkout terminals having cash verification systems therein, and monitors levels of cash within those POS terminals designated as BOC and for which the BOC cash is reflected within a financial institution account associated with the merchant. Upon execution of a cash transaction at a POS terminal involving BOC, the monitoring server updates quantities of cash stored within the POS terminal and provides data to a financial institution regarding the cash transaction.

17 Claims, 5 Drawing Sheets

(56) References Cited

U.S. PATENT DOCUMENTS

| | | | |
|---|---|---|---|
| 8,011,581 | B1 | 9/2011 | Folk et al. |
| 8,019,663 | B1 | 9/2011 | Bohen et al. |
| 8,025,214 | B1 | 9/2011 | Folk et al. |
| 8,032,415 | B2 | 10/2011 | Sanders et al. |
| 8,047,427 | B2 | 11/2011 | Sanders et al. |
| 8,056,305 | B1 | 11/2011 | Folk et al. |
| 8,096,398 | B2 | 1/2012 | Folk et al. |
| 8,117,127 | B1 | 2/2012 | Sanders et al. |
| 8,141,772 | B1 | 3/2012 | Folk et al. |
| 8,157,078 | B1 | 4/2012 | Folk et al. |
| 8,172,067 | B1 | 5/2012 | Folk et al. |
| 8,175,970 | B1 | 5/2012 | Mon et al. |
| 8,177,132 | B1 | 5/2012 | Bohen et al. |
| 8,181,854 | B1 | 5/2012 | Folk et al. |
| 8,181,856 | B1 | 5/2012 | Folk et al. |
| 8,196,826 | B2 | 6/2012 | Folk et al. |
| 8,201,680 | B1 | 6/2012 | Folk et al. |
| 8,210,429 | B1 | 7/2012 | Bohen et al. |
| 8,214,257 | B1 | 7/2012 | Folk et al. |
| 8,225,988 | B1 | 7/2012 | Bohen et al. |
| 8,227,936 | B1 | 7/2012 | Folk et al. |
| 8,260,669 | B1 | 9/2012 | Folk et al. |
| 8,272,563 | B1 | 9/2012 | Folk et al. |
| 8,274,364 | B1 | 9/2012 | Bohen et al. |
| 8,327,995 | B1 | 12/2012 | Folk et al. |
| 8,346,640 | B1 | 1/2013 | Sanders et al. |
| 8,387,874 | B1 | 3/2013 | Bohen et al. |
| 8,396,278 | B2 | 3/2013 | Jones et al. |
| 8,401,965 | B2 | 3/2013 | Johnson et al. |
| 8,407,119 | B2 | 3/2013 | Folk et al. |
| 8,430,303 | B1 | 4/2013 | Sanders et al. |
| 8,517,257 | B1 | 8/2013 | Folk et al. |
| 8,556,166 | B1 | 10/2013 | Folk et al. |
| 8,561,885 | B1 | 10/2013 | Folk et al. |
| 8,571,948 | B1 | 10/2013 | Nichols et al. |
| 8,600,842 | B1 | 12/2013 | Sanders et al. |
| 8,601,771 | B2 | 12/2013 | Folk et al. |
| 8,602,295 | B1 | 12/2013 | Sanders et al. |
| 8,640,945 | B1 | 2/2014 | McCormick |
| 8,781,903 | B1 | 7/2014 | Bohen et al. |
| 8,812,366 | B2 | 8/2014 | Folk et al. |
| 8,812,394 | B1 | 8/2014 | Folk et al. |
| 8,909,547 | B2 | 12/2014 | Bohen et al. |
| 8,925,797 | B1 | 1/2015 | Bohen et al. |
| 9,004,352 | B1 | 4/2015 | Graef et al. |
| 9,064,366 | B1 | 6/2015 | Folk et al. |
| 9,070,125 | B1 | 6/2015 | Folk et al. |
| 9,098,960 | B1 | 8/2015 | Folk et al. |
| 9,311,671 | B2 | 4/2016 | Folk et al. |
| 9,547,848 | B2 | 1/2017 | Folk et al. |
| 9,697,493 | B2 | 7/2017 | Folk et al. |
| 9,715,793 | B1 | 7/2017 | Brancaccio |
| 2005/0027626 | A1 | 2/2005 | Garcia |
| 2005/0289030 | A1 | 12/2005 | Smith |
| 2006/0253349 | A1* | 11/2006 | Brooks ..... G06Q 20/20 705/30 |
| 2009/0070263 | A1 | 3/2009 | Davis et al. |
| 2011/0060639 | A1 | 3/2011 | Garcia |
| 2011/0258090 | A1 | 10/2011 | Bosch et al. |
| 2012/0073482 | A1 | 3/2012 | Meeker et al. |
| 2013/0191196 | A1 | 7/2013 | Cecala |
| 2013/0232064 | A1 | 9/2013 | Bosch |
| 2013/0346135 | A1 | 12/2013 | Siemens et al. |
| 2014/0279675 | A1 | 9/2014 | Wiig et al. |
| 2014/0353375 | A1 | 12/2014 | Turocy et al. |
| 2017/0061561 | A1 | 3/2017 | Cha |
| 2017/0232300 | A1 | 8/2017 | Tran et al. |
| 2018/0005196 | A1 | 1/2018 | Crandall et al. |
| 2018/0078843 | A1 | 3/2018 | Tran et al. |
| 2018/0218323 | A1 | 8/2018 | Nguyen |
| 2018/0240190 | A1 | 8/2018 | Schumacher |
| 2018/0293649 | A1* | 10/2018 | Morgan ..... G06Q 20/20 |
| 2018/0300703 | A1* | 10/2018 | Hiramatsu ..... G06K 7/1417 |
| 2019/0220839 | A1 | 7/2019 | Oliynyk |

OTHER PUBLICATIONS

United States Patent and Trademark Office, NonFinal Office Action for U.S. Appl. No. 16/516,000, dated Aug. 13, 2020, (17 pages), U.S.

Unpublished U.S. Appl. No. 12/241,397, filed Sep. 30, 2008.

* cited by examiner

SYSTEMS AND METHODS FOR CASH-TILL OPTIMIZATION

CROSS-REFERENCE TO RELATED APPLICATIONS

This patent application claims priority to U.S. Provisional Application No. 62/863,382, filed Jun. 19, 2019, each of which is incorporated herein by reference in their entirety.

BACKGROUND

Brick-and-Mortar retailers are faced with requirements for exchanging cash during a large number of customer-facing transactions throughout a business day. In general, these transactions result in the amount of cash held by the brick-and-mortar retailers increasing throughout the business day, as customers purchase goods and/or services from the retailers. These transactions generally occur at point-of-sale (POS) terminals, such as employee-operated POS terminals or self-checkout (SCO) terminals. These retailers often face challenges with monitoring the cash exchange transactions to ensure the proper amount of cash is received (and/or dispensed) during a particular transaction because these transactions occur at disparate locations within the retail establishment.

Moreover, over the course of a business day, each POS terminal may collect a large amount of cash therein. While these POS terminals have some security features to inhibit unauthorized access to cash stored therein, retailers generally desire to minimize the amount of cash within POS terminals while maintaining at least a minimum amount of operating funds within each POS terminal. The remaining funds may be deposited into a more secure safe, a cash handing device, or directed to a banking institution. Accordingly, a need exists for systems and methods for optimizing the amount of cash located within POS terminals at a retail establishment.

BRIEF SUMMARY

Various embodiments encompass computer-implemented methods and systems for providing executable instructions to various POS terminals (e.g., SCO terminals) via a centralized (e.g., cloud-based) monitoring server to cause those various POS terminals to physically move defined quantities of cash stored therein, to dispense cash stored therein, and/or to accept cash presented thereto, during one or more cash management transactions to facilitate movement of cash between various POS terminals, a cash handling device (CHD), and/or the like. Moreover, one or more POS terminals may comprise one or more imaging devices configured to identify individual cash pieces deposited therein to certify the amount of cash stored therein. These POS terminals (e.g., SCO terminals) may periodically provide data to the centralized monitoring server (e.g., directly or indirectly) indicative of the amount of cash stored therein, and such data may be provided to one or more financial institutions thereby enabling the financial institutions to provide a credit to the retailer for at least a portion of cash stored within one or more POS terminals.

Various embodiments are directed to a Point-of-Sale (POS) terminal cash till management computing system for managing cash physically located within a plurality of POS terminals, the computing system comprising: one or more non-transitory memory storage areas, wherein the one or more non-transitory memory storage areas store a cash ledger for each of a plurality of POS terminals, wherein the cash ledger defines at least two accounting treatments for cash physically stored within a POS terminal; and one or more processors collectively configured to: receive one or more cash utilization data objects indicative of one or more cash transactions occurring at the plurality of POS terminals, wherein each of the one or more cash utilization data objects comprises data identifying an accounting treatment corresponding with the cash transaction; generate a message corresponding to one or more cash transactions identified as a first accounting treatment; transmit the message corresponding to the one or cash transactions identified as the first accounting treatment to an external financial institution computing entity to enable execution of financial transactions associated with a financial account at the external financial institution; and update the cash ledger stored for each of the plurality of POS terminals to reflect a change in cash quantity within at least one of the plurality of POS terminals and wherein the change in cash quantity is reflected within a change in cash quantity associated with the accounting treatment corresponding with the cash transaction of the at least two accounting treatments.

In certain embodiments, the accounting treatment corresponding with the cash transaction is a Bank-Owned Cash (BOC) accounting treatment, and wherein transmitting the message corresponding to the one or more cash transactions to the external financial institution computing entity causes execution of a financial transaction to change an amount of funds within the financial account, wherein the financial account is associated with an entity managing the plurality of POS terminals. Moreover, in various embodiments, updating the cash ledger comprises updating data indicating a quantity of cash stored within a POS terminal and subject to the accounting treatment corresponding with the cash transaction, at a cash denominational level. In certain embodiments, the one or more cash utilization data objects comprises data indicating the at least two accounting treatments correspond with the cash transaction and indicating a quantity of cash associated with each of the at least two accounting treatments. Moreover, generating a message corresponding to one or more cash transactions identified as the first accounting treatment may comprise generating a message identifying a first quantity of cash associated with the one or more cash transactions subject to the first accounting treatment; and updating the cash ledger may comprise updating the cash ledger to reflect a change in cash quantity within at least one of the plurality of POS terminals subject to each of the at least two accounting treatments. In certain embodiments, the at least two accounting treatments comprises the first accounting treatment and a second accounting treatment, and wherein the one or more processors are further configured to: update the cash ledger stored for at least one POS terminal to reflect a change in accounting treatment for a quantity of cash from the first accounting treatment to the second accounting treatment; generate a message comprising data identifying the change in accounting treatment for the quantity of cash; and transmit the message comprising data identifying the change in accounting treatment for the quantity of cash to an external financial institution computing entity to enable execution of financial transactions associated with a financial account at the external financial institution.

In certain embodiments, the one or more processors are further configured to: transmit data to a POS terminal based at least in part on the change in accounting treatment for a quantity of cash from the first accounting treatment to the second accounting treatment to cause the POS terminal to move the quantity of cash from a first storage location corresponding with the first accounting treatment to a second storage location corresponding with the second accounting treatment.

Various embodiments are directed to a computer-implemented method for managing cash physically located within a plurality of Point-of-Sale (POS) terminals, the method comprising: storing, within one or more non-transitory memory storage areas, a cash ledger for each of a plurality of POS terminals, wherein the cash ledger defines at least two accounting treatments for cash physically stored within a POS terminal; receiving, via one or more processors, one or more cash utilization data objects indicative of one or more cash transactions occurring at the plurality of POS terminals, wherein each of the one or more cash utilization data objects comprises data identifying an accounting treatment corresponding with the cash transaction; generating, via the one or more processors, a message corresponding to one or more cash transactions identified as a first accounting treatment; transmitting, via the one or more processors, the message corresponding to the one or cash transactions identified as the first accounting treatment to an external financial institution computing entity to enable execution of financial transactions associated with a financial account at the external financial institution; and updating, via the one or more processors, the cash ledger stored for each of the plurality of POS terminals to reflect a change in cash quantity within at least one of the plurality of POS terminals and wherein the change in cash quantity is reflected within a change in cash quantity associated with the accounting treatment corresponding with the cash transaction of the at least two accounting treatments.

In various embodiments, the accounting treatment corresponding with the cash transaction is a Bank-Owned Cash (BOC) accounting treatment, and wherein transmitting the message corresponding to the one or more cash transactions to the external financial institution computing entity causes execution of a financial transaction to change an amount of funds within the financial account, wherein the financial account is associated with an entity managing the plurality of POS terminals. Moreover, in certain embodiments, updating the cash ledger comprises updating data indicating a quantity of cash stored within a POS terminal and subject to the accounting treatment corresponding with the cash transaction, at a cash denominational level. In various embodiments, the one or more cash utilization data objects comprises data indicating the at least two accounting treatments correspond with the cash transaction and indicating a quantity of cash associated with each of the at least two accounting treatments. In certain embodiments, generating a message corresponding to one or more cash transactions identified as the first accounting treatment comprises generating a message identifying a first quantity of cash associated with the one or more cash transactions subject to the first accounting treatment; and updating the cash ledger comprises updating the cash ledger to reflect a change in cash quantity within at least one of the plurality of POS terminals subject to each of the at least two accounting treatments. Moreover, in various embodiments, the at least two accounting treatments comprises the first accounting treatment and a second accounting treatment, and wherein the method further comprises: updating the cash ledger stored for at least one POS terminal to reflect a change in accounting treatment for a quantity of cash from the first accounting treatment to the second accounting treatment; generating a message comprising data identifying the change in accounting treatment for the quantity of cash; and transmitting the message comprising data identifying the change in accounting treatment for the quantity of cash to an external financial institution computing entity to enable execution of financial transactions associated with a financial account at the external financial institution. Moreover, the method may further comprise: transmitting data to a POS terminal based at least in part on the change in accounting treatment for a quantity of cash from the first accounting treatment to the second accounting treatment to cause the POS terminal to move the quantity of cash from a first storage location corresponding with the first accounting treatment to a second storage location corresponding with the second accounting treatment.

Certain embodiments are directed to a computer program product comprising a non-transitory computer readable medium having computer program instructions stored therein, the computer program instructions when executed by a processor, cause the processor to: store, within one or more non-transitory memory storage areas, a cash ledger for each of a plurality of POS terminals, wherein the cash ledger defines at least two accounting treatments for cash physically stored within a POS terminal; receive, via one or more processors, one or more cash utilization data objects indicative of one or more cash transactions occurring at the plurality of POS terminals, wherein each of the one or more cash utilization data objects comprises data identifying an accounting treatment corresponding with the cash transaction; generate, via the one or more processors, a message corresponding to one or more cash transactions identified as a first accounting treatment; transmit, via the one or more processors, the message corresponding to the one or cash transactions identified as the first accounting treatment to an external financial institution computing entity to enable execution of financial transactions associated with a financial account at the external financial institution; and update, via the one or more processors, the cash ledger stored for each of the plurality of POS terminals to reflect a change in cash quantity within at least one of the plurality of POS terminals and wherein the change in cash quantity is reflected within a change in cash quantity associated with the accounting treatment corresponding with the cash transaction of the at least two accounting treatments.

In certain embodiments, the accounting treatment corresponding with the cash transaction is a Bank-Owned Cash (BOC) accounting treatment, and wherein transmitting the message corresponding to the one or more cash transactions to the external financial institution computing entity causes execution of a financial transaction to change an amount of funds within the financial account, wherein the financial account is associated with an entity managing the plurality of POS terminals. In various embodiments, updating the cash ledger comprises updating data indicating a quantity of cash stored within a POS terminal and subject to the accounting treatment corresponding with the cash transaction, at a cash denominational level. Moreover, in certain embodiments, the one or more cash utilization data objects comprises data indicating the at least two accounting treatments correspond with the cash transaction and indicating a quantity of cash associated with each of the at least two accounting treatments. In various embodiments, generating a message corresponding to one or more cash transactions identified as the first accounting treatment comprises generating a message identifying a first quantity of cash associated with the one or more cash transactions subject to the first accounting treatment; and updating the cash ledger comprises updating the cash ledger to reflect a change in cash quantity within at least one of the plurality of POS terminals subject to each of the at least two accounting treatments. In certain embodiments, the at least two accounting treatments comprises the first accounting treatment and a second accounting treatment, and wherein the computer program instructions when executed by a processor, further cause the processor to: update the cash ledger stored for at least one POS terminal to reflect a change in accounting treatment for a quantity of cash from the first accounting treatment to the second accounting treatment; generate a message comprising data identifying the change in accounting treatment for the quantity of cash; and transmit the message comprising data identifying the change in accounting treatment for the quantity of cash to an external financial institution computing entity to enable execution of financial transactions associated with a financial account at the external financial institution.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
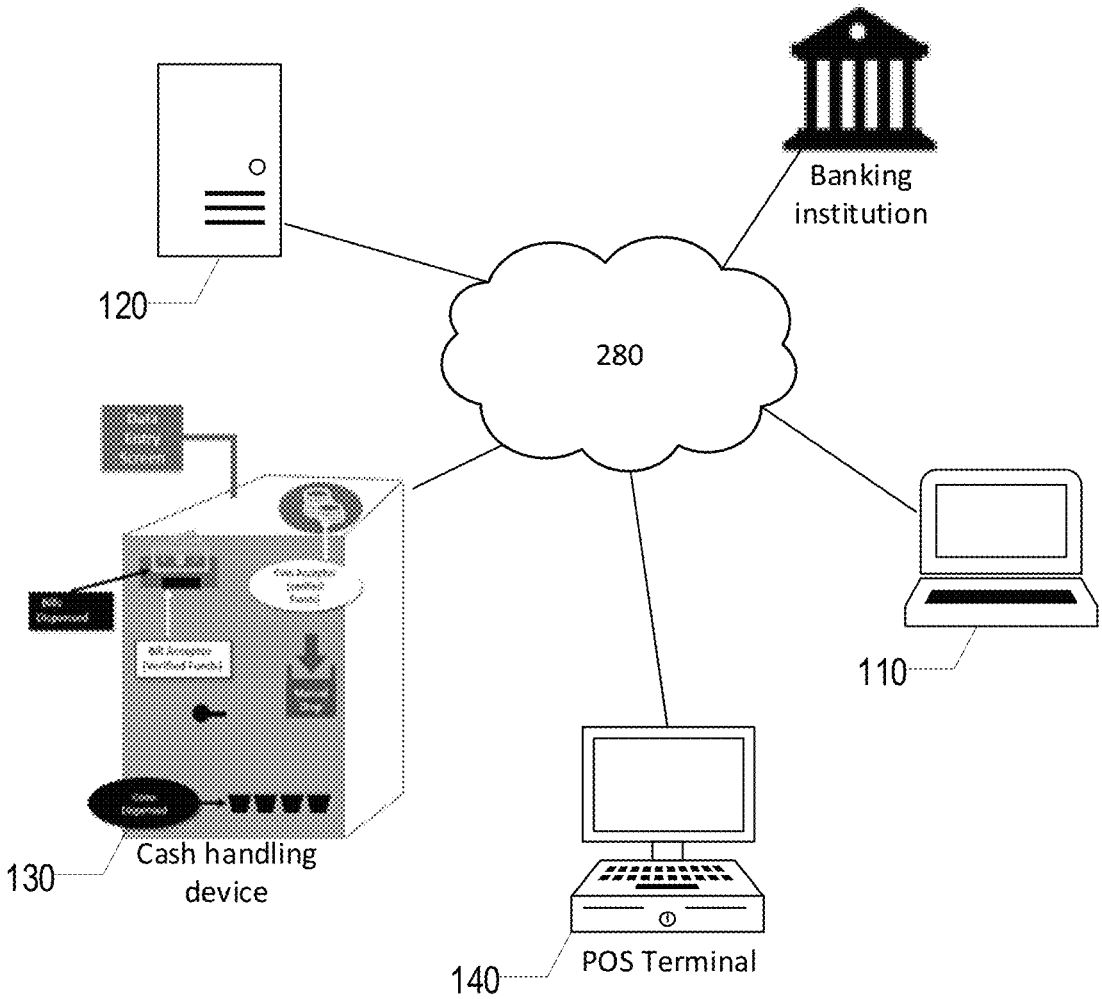
FIG. 1 illustrates a network environment in which data may be transferred regarding the functionality of a cash handling device according to certain embodiments.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

Certain embodiments enable point-of-sale (POS) terminals (such as self-checkout (SCO) terminals) to implement one or more cash treatment approaches to cash physically stored therein. For example, a first cash treatment approach may be applicable to a first quantity of cash stored therein (e.g., cash stored within a deposit cassette also referred to as an overflow cashbox), and a second cash treatment approach may be applicable to a second quantity of cash stored therein (e.g., cash stored within a recycler cassette). As yet another example, a first cash treatment approach may be applicable during a first time period (e.g., during a business day) and a second cash treatment approach may be applicable during a second time period (e.g., after electronic reconciliation of cash stored within the POS terminal). As a specific example, a defined quantity of cash stored within the POS terminal may be treated as bank-owned-cash (BOC), while any cash exceeding the defined BOC quantity may be treated as customer-owned cash, subject to different accounting principles than the BOC. In certain embodiments, distinctions in cash treatment approaches may be applied in the aggregate to cash stored within the POS (e.g., across multiple denominations). In other embodiments, the distinctions in cash treatment approaches may be applied within each denomination (e.g., each denomination having a defined quantity of BOC).

As just one example, certain embodiments are configured to enable customer-facing transactions to include BOC at a POS terminal of a merchant. Thus, in certain instances, a transaction between a merchant and a customer (e.g., a purchase transaction or a customer-refund transaction), may result in BOC being dispensed from the POS terminal to the customer, or customer-cash being added to the POS terminal and being treated as BOC. In such instances, the monitoring server monitors the amount of cash within the POS terminal and provides data indicative of transactions to a financial institution such that the financial institution may credit or debit cash from an account associated with the merchant, as cash within the POS terminal and designated as BOC is involved in transactions.

In certain embodiments, cash subject to BOC accounting principles may be intermingled with cash subject to customer-owned cash accounting principles within the POS terminal, such that the cash is not physically separated within the POS terminal. Although the cash is intermingled within the POS terminal, the POS terminal may have a dispensing/receiving operation subject to Last-In-First-Out (LIFO) accounting, such that the most recently received bill (within a particular denomination) will be the next bill distributed during the same or a later transaction. Using LIFO accounting, the BOC may be positioned at the back end of a stack of bills (these bills effectively being considered the "first in" and therefore the "last out" under this accounting), such that bills designated as BOC are not utilized within normal transactions unless and until all customer-owned cash is exhausted. It should be understood that other accounting methodologies may be utilized in other embodiments.

According to certain embodiments, designations of cash stored within one or more POS terminals as BOC are generated and/or maintained at a monitoring server located geographically remotely from the POS terminals. The monitoring server provides data to each of the one or more POS terminals indicating the quantity and/or denominations of cash designated at BOC, which causes the POS terminals to adjust operations to accommodate the BOC designation. For example, designations of BOC may cause the POS terminal to not dispense cash designated as BOC unless and until receiving an additional instruction to the contrary. In other embodiments, the POS terminal may be configured to dispense BOC in a manner analogous to customer-owned cash, but the POS terminal may transmit real-time updates to the monitoring server of dispensed BOC, thereby enabling the monitoring server to generate and send BOC usage data to one or more financial institutions, such that the customer's financial institution account may be updated to reflect the BOC usage.

Computer Program Products, Methods, and Computing Entities

Embodiments of the present invention may be implemented in various ways, including as computer program products that comprise articles of manufacture. Such computer program products may include one or more software components including, for example, software objects, methods, data structures, and/or the like. A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform. Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, and/or a report writing language. In one or more example embodiments, a software component comprising instructions in one of the foregoing examples of programming languages may be executed directly by an operating system or other software component without having to be first transformed into another form. A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution). The terms software, computer program product, and similar words may be used herein interchangeably.

A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, computer program products, program code, and/or similar terms used herein interchangeably). Such non-transitory computer-readable storage media include all computer-readable media (including volatile and non-volatile media/memory).

In one embodiment, a non-volatile computer-readable storage medium may include a floppy disk, flexible disk, hard disk, solid-state storage (SSS) (e.g., a solid state drive (SSD), solid state card (SSC), or solid state module (SSM)), enterprise flash drive, magnetic tape, or any other non-transitory magnetic medium, and/or the like. A non-volatile computer-readable storage medium may also include a punch card, paper tape, optical mark sheet (or any other physical medium with patterns of holes or other optically recognizable indicia), compact disc read only memory (CD-ROM), compact disc-recordable (CD-R), compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, SmartMedia cards, CompactFlash (CF) cards, Memory Sticks, and/or the like. Further, a non-volatile computer-readable storage medium may also include conductive-bridging random access memory (CBRAM), phase-change random access memory (PRAM), ferroelectric random-access memory (FeRAM), non-volatile random-access memory (NVRAM), magnetoresistive random-access memory (MRAM), resistive random-access memory (RRAM), Silicon-Oxide-Nitride-Oxide-Silicon memory (SONOS), floating junction gate random access memory (FJG RAM), Millipede memory, racetrack memory, and/or the like.

In one embodiment, a volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, register memory, and/or the like. It will be appreciated that where embodiments are described to use a computer-readable storage medium, other types of computer-readable storage media may be substituted for or used in addition to the computer-readable storage media described above.

As should be appreciated, various embodiments of the present invention may also be implemented as methods, apparatus, systems, computing devices, computing entities, and/or the like. As such, embodiments of the present invention may take the form of an apparatus, system, computing device, computing entity, and/or the like executing instructions stored on a computer-readable storage medium to perform certain steps or operations. Thus, embodiments of the present invention may also take the form of an entirely hardware embodiment, an entirely computer program product embodiment, and/or an embodiment that comprises combination of computer program products and hardware performing certain steps or operations.

Embodiments of the present invention are described below with reference to block diagrams and flowchart illustrations. Thus, it should be understood that each block of the block diagrams and flowchart illustrations may be implemented in the form of a computer program product, an entirely hardware embodiment, a combination of hardware and computer program products, and/or apparatus, systems, computing devices, computing entities, and/or the like carrying out instructions, operations, steps, and similar words used interchangeably (e.g., the executable instructions, instructions for execution, program code, and/or the like) on a computer-readable storage medium for execution. For example, retrieval, loading, and execution of code may be performed sequentially such that one instruction is retrieved, loaded, and executed at a time. In some exemplary embodiments, retrieval, loading, and/or execution may be performed in parallel such that multiple instructions are retrieved, loaded, and/or executed together. Thus, such embodiments can produce specifically-configured machines performing the steps or operations specified in the block diagrams and flowchart illustrations. Accordingly, the block diagrams and flowchart illustrations support various combinations of embodiments for performing the specified instructions, operations, or steps.

Exemplary System Architecture

FIG. 1 provides an illustration of an exemplary embodiment of the present invention. As shown in FIG. 1, this particular embodiment may include one or more monitoring servers 120, one or more mobile devices 110, one or more cash handling devices 130 as discussed herein, one or more networks 280 enabling communication among computing devices and a banking institution (e.g., a banking institution server system), and/or the like. Each of these components, entities, devices, systems, and similar words used herein interchangeably may be in direct or indirect communication with, for example, one another over the same or different wired or wireless networks. Additionally, while FIG. 1 illustrates the various system entities as separate, standalone entities, the various embodiments are not limited to this particular architecture.

Monitoring Server

Figure 2:
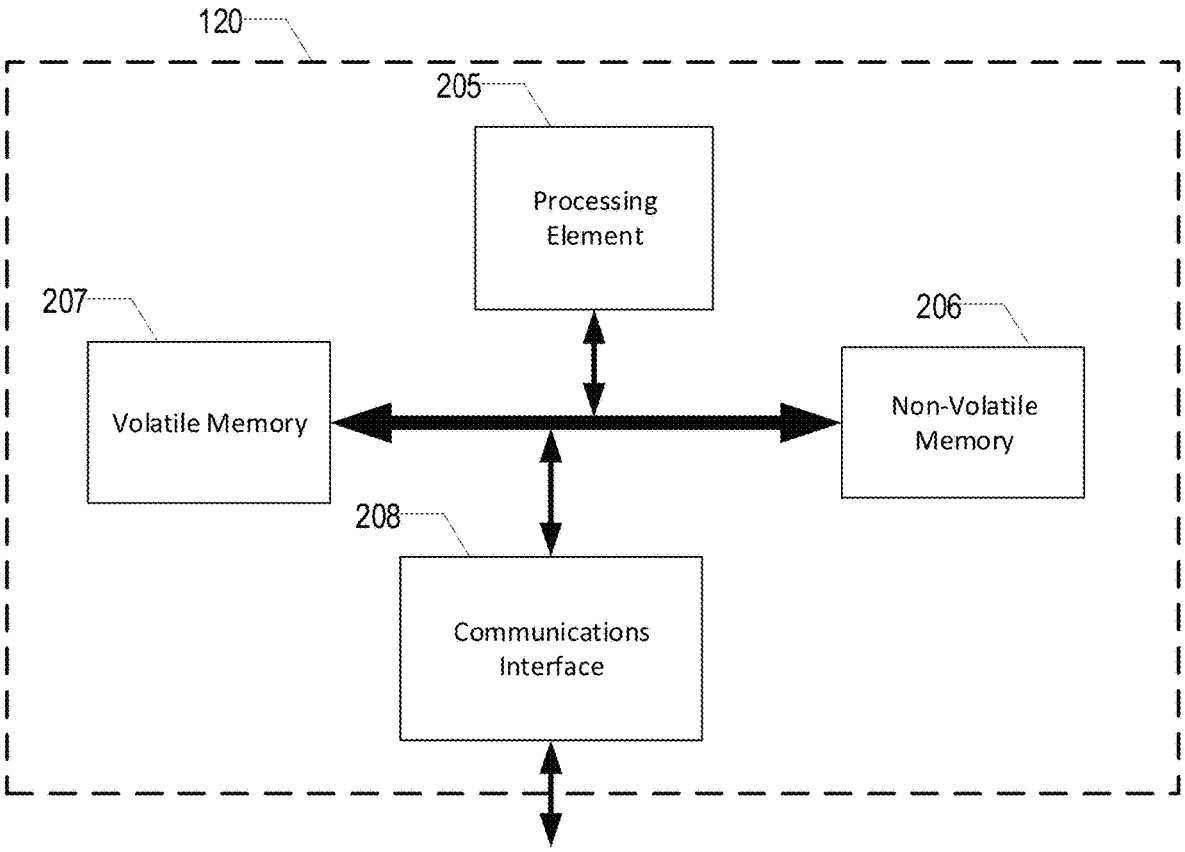
FIG. 2 schematically illustrates features of a monitoring server according to certain embodiments.

FIG. 2 provides a schematic of a monitoring server 120 according to one embodiment of the present invention. In one embodiment, the monitoring server 120 may be in network communication with one or more cash handling devices 130 for monitoring transactions occurring in association with those cash handling devices 130, one or more banking institutions to transmit transaction data to appropriate banking institutions and/or one or more mobile devices 110 to provide various summary data thereto. In certain embodiments, the monitoring server 120 may be operable in association with other computing devices and/or platforms (e.g., operable via third parties, such as banking institutions' online banking platforms) to accomplish certain functions (e.g., user authentication) to retrieve certain data, and/or the like. In general, the terms computing entity, computer, entity, device, system, server, machine, and/or similar words used herein interchangeably may refer to, for example, one or more computers, computing entities, desktop computers, mobile phones, tablets, phablets, notebooks, laptops, distributed systems, input terminals, servers or server networks, blades, gateways, switches, processing devices, processing entities, set-top boxes, relays, routers, network access points, base stations, the like, and/or any combination of devices or entities adapted to perform the functions, operations, and/or processes described herein. Such functions, operations, and/or processes may include, for example, transmitting, receiving, operating on, processing, controlling, remotely controlling, dispensing, displaying, storing, determining, creating/generating, monitoring, evaluating, comparing, and/or similar terms used herein interchangeably. In one embodiment, these functions, operations, and/or processes can be performed on data, content, information, and/or similar terms used herein interchangeably.

In one embodiment, the monitoring server 120 may include or be in communication with one or more monitoring server data repositories and/or one or more processing elements 205 (also referred to as processors, processing circuitry, processing device, and/or similar terms used herein interchangeably) that communicate with other elements within the monitoring server 120 via a bus, for example. In certain embodiments, the monitoring server data repositories may maintain a wide variety of data accessible to the monitoring server 120, such as user-specific items (e.g., user (login) ID, password (or other authentication credential(s)), one or more account number(s), user name, user registration status, and/or the like). As will be understood, the processing element 205 may be embodied in a number of different ways. For example, the processing element 205 may be embodied as one or more complex programmable logic devices (CPLDs), "cloud" processors, microprocessors, multi-core processors, coprocessing entities, application-specific instruction-set processors (ASIPs), microcontrollers, and/or controllers. Further, the processing element 205 may be embodied as one or more other processing devices or circuitry. The term circuitry may refer to an entirely hardware embodiment or a combination of hardware and computer program products. Thus, the processing element 205 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 205 may be configured for a particular use or configured to execute instructions stored in volatile or non-volatile media/memory or otherwise accessible to the processing element 205. As such, whether configured by hardware or computer program products, or by a combination thereof, the processing element 205 may be capable of performing steps or operations according to embodiments of the present invention when configured accordingly.

In one embodiment, the monitoring server 120 may further include or be in communication with non-volatile media/memory (also referred to as non-volatile storage, memory, memory storage, memory circuitry and/or similar terms used herein interchangeably). In one embodiment, the non-volatile storage or memory may include one or more non-volatile storage or memory media 206, including but not limited to hard disks, ROM, PROM, EPROM, EEPROM, flash memory, MMCs, SD memory cards, Memory Sticks, CBRAM, PRAM, FeRAM, NVRAM, MRAM, RRAM, SONOS, FJG RAM, Millipede memory, racetrack memory, and/or the like. As will be recognized, the non-volatile storage or memory media may store databases, database instances, database management systems, data, applications, programs, program modules, scripts, source code, object code, byte code, compiled code, interpreted code, machine code, executable instructions, and/or the like. The term database, database instance, database management system, and/or similar terms used herein interchangeably may refer to a collection of records or information/data that is stored in a computer-readable storage medium using one or more database models, such as a hierarchical database model, network model, relational model, entity-relationship model, object model, document model, semantic model, graph model, and/or the like.

In one embodiment, the monitoring server 120 may further include or be in communication with volatile media/memory (also referred to as volatile storage, memory, memory storage, memory circuitry and/or similar terms used herein interchangeably). In one embodiment, the volatile storage or memory may also include one or more volatile storage or memory media 207, including but not limited to RAM, DRAM, SRAM, FPM DRAM, EDO DRAM, SDRAM, DDR SDRAM, DDR2 SDRAM, DDR3 SDRAM, RDRAM, TTRAM, T-RAM, Z-RAM, RIMM, DIMM, SIMM, VRAM, cache memory, register memory, and/or the like. As will be recognized, the volatile storage or memory media may be used to store at least portions of the databases, database instances, database management systems, data, applications, programs, program modules, scripts, source code, object code, byte code, compiled code, interpreted code, machine code, executable instructions, and/or the like being executed by, for example, the processing element 205. Thus, the databases, database instances, database management systems, data, applications, programs, program modules, scripts, source code, object code, byte code, compiled code, interpreted code, machine code, executable instructions, and/or the like may be used to control certain aspects of the operation of the monitoring server 120 with the assistance of the processing element 205 and operating system.

As indicated, in one embodiment, the monitoring server 120 may also include one or more communications elements/interfaces 208 for communicating with various computing entities, such as by communicating data, content, information, and/or similar terms used herein interchangeably that can be transmitted, received, operated on, processed, displayed, stored, and/or the like. For instance, the monitoring server 120 may communicate with one or more mobile devices 110, one or more cash handling devices 130, one or more networks 280, one or more banking institutions' computing systems, and/or the like.

In certain embodiments, the monitoring server 120 may be configured to receive data from a plurality of data sources with respect to cash inventory stored at a particular cash handling device 130, a particular POS terminal 140, and/or the like. For example, the cash handling device 130 and/or POS terminal 140 may provide data indicative of aggregate inputs and outputs of cash to the machine, while a user computing device may provide data indicative of how the aggregate inputs and outputs are divided among a plurality of retail tills (or registers, the terms being utilized herein interchangeably) (e.g., usable with respective POS devices). Accordingly, the monitoring server 120 may be configured to provide till-level inventory tracking configurations based at least in part on the aggregate amount of cash input to or output from a particular cash handling device 130 and/or POS terminal 140, as well as manually generated data provided from a user computing entity indicative of how the cash was distributed from/to a various tills.

As indicated, in one embodiment, the monitoring server 120 may also include one or more communications interfaces 208 for communicating with various computing entities, such as by communicating data, content, information, and/or similar terms used herein interchangeably that can be transmitted, received, operated on, processed, displayed, stored, and/or the like. Such communication may be executed using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, the monitoring server 120 may be configured to communicate via wireless external communication networks using any of a variety of protocols, such as general packet radio service (GPRS), Universal Mobile Telecommunications System (UMTS), Code Division Multiple Access 2000 (CDMA2000), CDMA2000 1× (1×RTT), Wideband Code Division Multiple Access (WCDMA), Global System for Mobile Communications (GSM), Enhanced Data rates for GSM Evolution (EDGE), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), Wi-Fi Direct, 802.16 (WiMAX), ultra-wideband (UWB), infrared (IR) protocols, near field communication (NFC) protocols, Wibree, Bluetooth protocols, wireless universal serial bus (USB) protocols, and/or any other wireless protocol. The monitoring server 120 may use such protocols and standards to communicate using Border Gateway Protocol (BGP), Dynamic Host Configuration Protocol (DHCP), Domain Name System (DNS), File Transfer Protocol (FTP), Hypertext Transfer Protocol (HTTP), HTTP over TLS/SSL/Secure, Internet Message Access Protocol (IMAP), Network Time Protocol (NTP), Simple Mail Transfer Protocol (SMTP), Telnet, Transport Layer Security (TLS), Secure Sockets Layer (SSL), Internet Protocol (IP), Transmission Control Protocol (TCP), User Datagram Protocol (UDP), Datagram Congestion Control Protocol (DCCP), Stream Control Transmission Protocol (SCTP), HyperText Markup Language (HTML), and/or the like.

Although not shown, the monitoring server 120 may include or be in communication with one or more input elements, such as a keyboard input, a mouse input, a touch screen/display input, motion input, movement input, audio input, pointing device input, joystick input, keypad input, and/or the like. In one embodiment, the monitoring server 120 may also include or be in communication with one or more output elements (not shown), such as audio output, video output, screen/display output, motion output, movement output, and/or the like.

As will be appreciated, one or more of the monitoring server's 120 components may be located remotely from other monitoring server 120 components, such as in a distributed system. Furthermore, one or more of the components may be combined and additional components performing functions described herein may be included in the monitoring server 120. Thus, the monitoring server 120 can be adapted to accommodate a variety of needs and circumstances. As will be recognized, these architectures and descriptions are provided for exemplary purposes only and are not limiting to the various embodiments.

Exemplary Mobile Device

In one embodiment, a user may be an individual, a representative of a customer, such as a company or organization, and/or the like who wants to deposit and/or withdraw cash from a cash handling device 130 as discussed above. The user may interact with a cash handling device 130 via a user interface thereon, and/or the user may interact with a mobile device 110 to obtain information/data regarding one or more accounts to which the user has access. As will be recognized, an account associated with a cash handling device 130 may be any of a number of different account types, including a bank-owned cash account, a non-bank owned cash account, and/or the like. Accounts may be associated and/or linked with any of a variety of banking institutions holding accounts on behalf of a customer. Moreover, an account could be associated with more than one user (e.g., a plurality of employees associated with a customer holding an account), and each user may have different account access credentials (e.g., a first user may have withdrawal and deposit access and a second user may have deposit only access to an account). Moreover, each user may have access to an account via different access identifiers (e.g., different user identifiers), or in certain embodiments each user may have access to the account via an identical access number. In other embodiments, a single user identifier may be associated with more than one account (e.g., accounts associated with a plurality of departments within a commercial customer).

Figure 3:
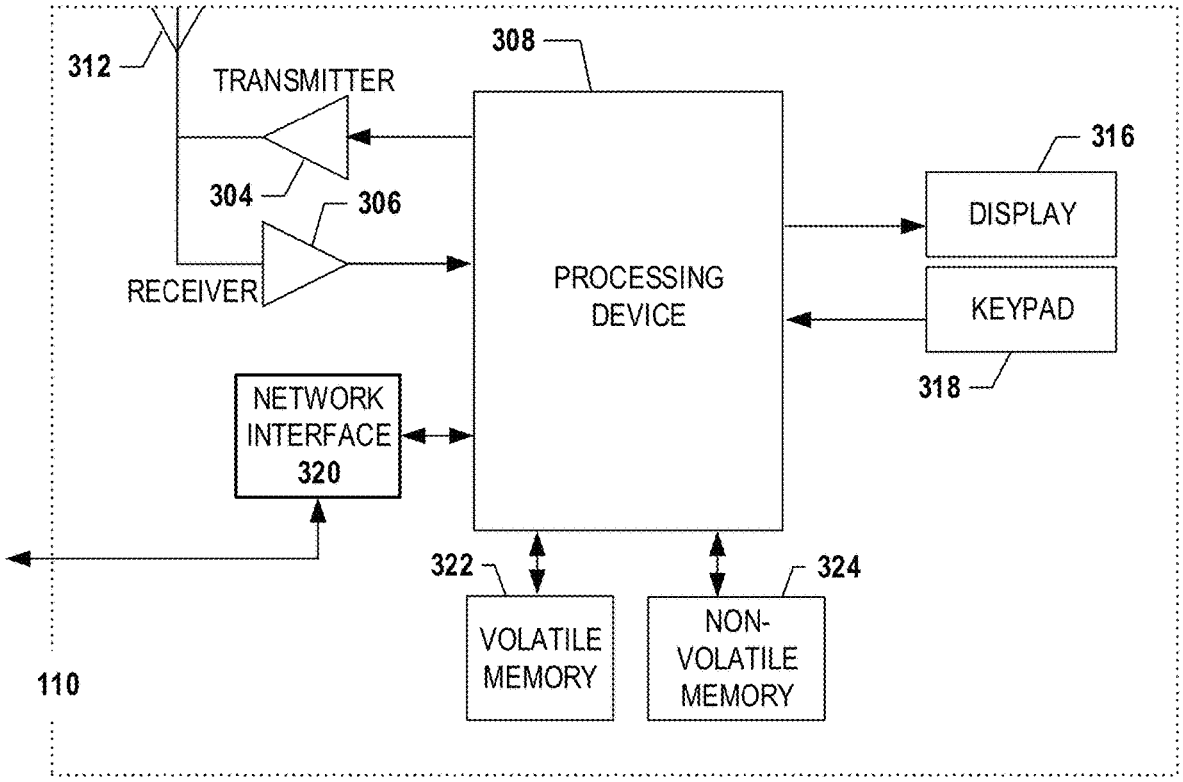
FIG. 3 schematically illustrates features of a handheld device according to certain embodiments.

The mobile device 110 includes one or more components that are functionally similar to those of the monitoring server 120. FIG. 3 provides an illustrative schematic representative of a mobile device 110 that can be used in conjunction with embodiments of the present invention. As noted previously, the terms device, system, computing entity, entity, server, and/or similar words used herein interchangeably may refer to at least, for example, one or more computers, computing entities, mobile phones, tablets, phablets, watches, glasses, ear pieces, wristbands, wearable items/devices, the like, and/or any combination of devices or entities adapted to perform the functions, operations, and/or processes described herein. As shown in FIG. 3, the mobile device 110 can include an antenna 312, a transmitter 304 (e.g., radio), a receiver 306 (e.g., radio), and a processing element 308 (e.g., CPLDs, microprocessors, multi-core processors, cloud processors, coprocessing entities, ASIPs, microcontrollers, and/or controllers) that provides signals to and receives signals from the transmitter 304 and receiver 306, respectively.

In one embodiment, the signals provided to and received from the transmitter 304 and the receiver 306, respectively, may include signaling information/data in accordance with air interface standards of applicable wireless systems. In this regard, the mobile device 110 may be capable of operating with one or more air interface standards, communication protocols, modulation types, and access types. More particularly, the mobile device 110 may operate in accordance with any of a number of wireless communication standards and protocols, such as those described above with regard to the monitoring server 120. In a particular embodiment, the mobile device 110 may operate in accordance with multiple wireless communication standards and protocols, such as UMTS, CDMA2000, 1×RTT, WCDMA, GSM, EDGE, TD-SCDMA, LTE, E-UTRAN, EVDO, HSPA, HSDPA, Wi-Fi, Wi-Fi Direct, WiMAX, UWB, IR, NFC, Bluetooth, USB, and/or the like. Similarly, the mobile device 110 may operate in accordance with multiple wired communication standards and protocols, such as those described above with regard to the monitoring server 120 via a network interface 320.

Via these communication standards and protocols, the mobile device 110 can communicate with various other entities using concepts such as Unstructured Supplementary Service Data (USSD), Short Message Service (SMS), Multimedia Messaging Service (MMS), Dual-Tone Multi-Frequency Signaling (DTMF), and/or Subscriber Identity Module Dialer (SIM dialer). In one embodiment, the mobile device 110 can also download changes, add-ons, and updates, for instance, to its firmware, software (e.g., including executable instructions, applications, program modules), and operating system.

According to one embodiment, the mobile device 110 may include location determining aspects, devices, modules, functionalities, and/or similar words used herein interchangeably. For example, the mobile device 110 may include outdoor positioning aspects, such as a location module adapted to acquire, for example, latitude, longitude, altitude, geocode, course, direction, heading, speed, universal time (UTC), date, and/or various other information/data. In one embodiment, the location module can acquire data, sometimes known as ephemeris data, by identifying the number of satellites in view and the relative positions of those satellites (e.g., using global positioning systems (GPS)). In one embodiment, the satellites may be a variety of different satellites, including Low Earth Orbit (LEO) satellite systems, Department of Defense (DOD) satellite systems, the European Union Galileo positioning systems, the Chinese Compass navigation systems, Indian Regional Navigational satellite systems, and/or the like. This information/data can be collected using a variety of coordinate systems, such as the Decimal Degrees (DD); Degrees, Minutes, Seconds (DMS); Universal Transverse Mercator (UTM); Universal Polar Stereographic (UPS) coordinate systems; and/or the like. Alternatively, the location information/data can be determined by triangulating the mobile device's 110 position in connection with a variety of other systems, including cellular towers, Wi-Fi access points, and/or the like. Similarly, the mobile device 110 may include indoor positioning aspects, such as a location module adapted to acquire, for example, latitude, longitude, altitude, geocode, course, direction, heading, speed, time, date, and/or various other information/data. Some of the indoor systems may use various position or location technologies including RFID tags, indoor beacons or transmitters, Wi-Fi access points, cellular towers, nearby computing devices (e.g., smartphones, laptops) and/or the like. For instance, such technologies may include the iBeacons, Gimbal proximity beacons, Bluetooth Low Energy (BLE) transmitters, Bluetooth Smart, Wi-Fi Direct transmitters, NFC transmitters, and/or the like. These indoor positioning aspects can be used in a variety of settings to determine the location of someone or something to within inches or centimeters.

In one embodiment, the mobile device 110 may also comprise a user interface (that can include a display 316 coupled to a processing element 308) and/or a user input interface (coupled to a processing element 308). For example, the user interface may be a user application, browser, user interface, interface, and/or similar words used herein interchangeably executing on and/or accessible via the mobile device 110 to interact with and/or cause display of information/data from the monitoring server 120, as described herein. The user input interface can comprise any of a number of devices or interfaces allowing the mobile device 110 to receive data, such as a keypad 318 (hard or soft), a touch display, voice/speech or motion interfaces, or other input device. In embodiments including a keypad 318, the keypad 318 can include (or cause display of) the conventional numeric (0-9) and related keys (#, *), and other keys used for operating the mobile device 110 and may include a full set of alphabetic keys or set of keys that may be activated to provide a full set of alphanumeric keys. In addition to providing input, the user input interface can be used, for example, to activate or deactivate certain functions, such as screen savers and/or sleep modes.

In certain embodiments, the user interface (e.g., the display 316) may be configured for displaying access credentials that may be presented to a cash handling device 130 to enable the user to gain account access via the cash handling device 130. For example, the user interface of the mobile device 110 may be utilized to display a QR code, a bar code, an image, and/or the like that is machine-readable and indicative of the user's access credentials. Similarly, the mobile device 110 may be configured for storing access credentials thereon, and transmitting those access credentials via any of a variety of wireless data transmission protocols (e.g., Bluetooth, Wi-Fi, NFC, and/or the like) to the cash handling device 130 to provide access credentials for the user to the cash handling device 130.

The mobile device 110 can also include volatile storage or memory 322 and/or non-volatile storage or memory 324, which can be embedded and/or may be removable. For example, the non-volatile memory may be ROM, PROM, EPROM, EEPROM, flash memory, MMCs, SD memory cards, Memory Sticks, CBRAM, PRAM, FeRAM, NVRAM, MRAM, RRAM, SONOS, FJG RAM, Millipede memory, racetrack memory, and/or the like. The volatile memory may be RAM, DRAM, SRAM, FPM DRAM, EDO DRAM, SDRAM, DDR SDRAM, DDR2 SDRAM, DDR3 SDRAM, RDRAM, TTRAM, T-RAM, Z-RAM, RIMM, DIMM, SIMM, VRAM, cache memory, register memory, and/or the like. The volatile and non-volatile storage or memory can store databases, database instances, database management systems, data, applications, programs, program modules, scripts, source code, object code, byte code, compiled code, interpreted code, machine code, executable instructions, and/or the like to implement the functions of the mobile device 110. As indicated, this may include a user application that is resident on the entity or accessible through a browser or other user interface for communicating with the monitoring server 120 and/or various other computing entities.

As will be recognized, the mobile device 110 may include one or more components or functionality that are the same or similar to those of the monitoring server 120, as described in greater detail above. As will be recognized, these architectures and descriptions are provided for exemplary purposes only and are not limiting to the various embodiments.

Cash Handling Device Hardware

Figure 4:
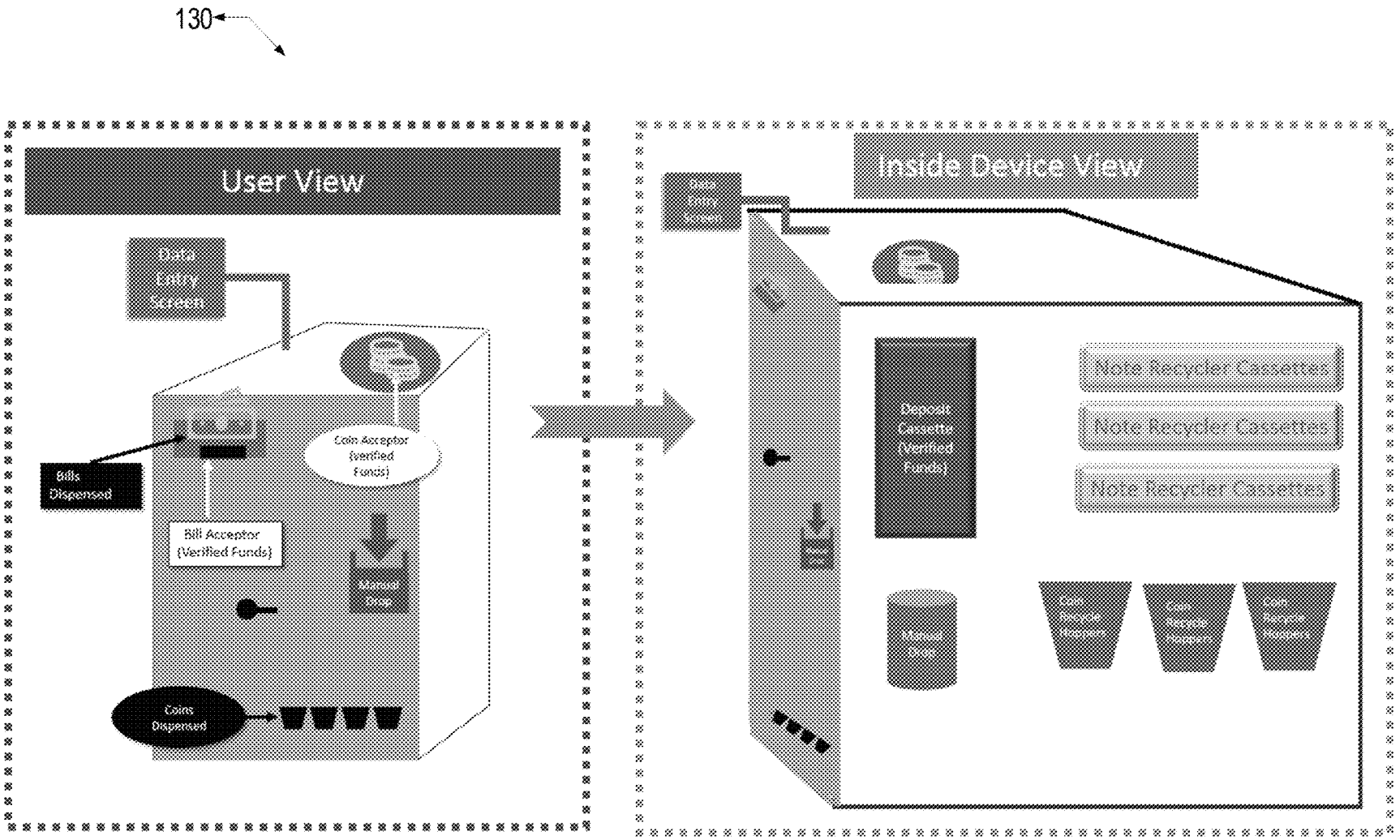
FIG. 4 schematically illustrates features of a cash handling device according to certain embodiments.

An example cash handling device 130 is shown schematically at FIG. 4. As shown therein, components of the cash handling device 130 are disposed within and/or on a housing. The cash handling device 130 may comprise a user interface (e.g., an LCD monitor, a PIN-pad, and/or the like), one or more data readers (e.g., a card reader, a barcode reader, an NFC reader, a camera (which may also be utilized for recording security footage), a biometric reader, and/or the like). In certain embodiments, the cash handling device 130 hardware may comprise one or more secure information storage areas configured to securely store user data (e.g., user identifiers, user passwords/passcodes, user biometric data, and/or the like) to prevent unauthorized access to such user data. These secure information storage areas may be accessible to certain authorized users, thereby enabling those authorized users to add or remove user data, for example, as new employees/users become authorized to interact with the cash handling device 130 and/or as prior employees/users are no longer authorized to interact with the cash handling device 130.

The cash handling device 130 may further comprise one or more currency outputs (e.g., a coin dispenser, such as a rolled coin dispenser or a loose coin dispenser, a note dispenser, such as a loose note dispenser or a bound-note dispenser, and/or the like), one or more currency and/or negotiable instrument inputs (e.g., a coin recycler, a check/note scanner/recycler, a deposit cassette, and/or the like), a receipt printer, and/or the like. As discussed herein, the cash handling device 130 may additionally comprise a retail till receiving portion configured to receive a retail till during receipt and/or distribution of cash stored within the retail till. In certain embodiments, the retail till receiving portion may further comprise a retail till identifier scanner configured to obtain retail till identifier data for tills located therein, such that data indicative of cash added to and/or removed from the retail till may be associated with the retail till identifier.

The cash handling device 130 components collectively enable a user (e.g., a representative of a particular commercial establishment customer having an account accessible via the cash handling device 130) to deposit and/or withdraw funds from the cash handling device 130 (which may result in corresponding changes to an account balance in an account held at a particular banking institution for the commercial establishment), for example, when emptying or filling a retail till. In certain embodiments, the cash handling device 130 may enable users to withdraw currency in requested quantities and denominations (e.g., requested quantities of each of a plurality of denominations). Users may interact with the cash handling device 130 via the one or more user interface mechanisms to (1) provide user identifying data (e.g., via the one or more data readers, the PIN pad, a touch screen, and/or the like), and (2) to provide data indicative of a requested transaction to be performed with the cash handling device 130.

In certain embodiments, a plurality of users may be associated with a single account with the cash handling device 130, and each of those users may be associated with differing account access levels. For example, a first user may have deposit and withdrawal access for a particular account, while a second user may only have deposit access for the particular account. Data indicative of the access credentials for each user may be stored locally in a non-transitory memory of the cash handling device 130, on a memory within a physical identification token (e.g., a card) carried by the user, and/or the like.

With reference to FIG. 4, which illustrates a schematic view of various components of a cash handling device 130 according to one embodiment, the cash handling device 130 may comprise one or more components of a note (e.g., note) circulation system and one or more components of a coin circulation system.

In the illustrated embodiment, the note circulation system encompasses a note acceptor configured for providing notes to a user and/or for accepting notes deposited by a user. The note acceptor may be configured for processing a plurality of notes simultaneously (e.g., presented to the note acceptor in a stack) to speed transactions with the user. Notes passed between the note acceptor and one or more note recycler cassettes and/or deposit cassettes (illustrated in FIG. 4) are counted, imaged, and/or otherwise verified to monitor the quantity of notes deposited/withdrawn, as well as the denomination of those notes. Through the verification mechanism of the note acceptor, the note circulation system may be configured to separate out negotiable instruments (e.g., checks) and/or certain notes for direction to separate storage locations, and/or to separate out and return unreadable notes and/or unreadable negotiable instruments to a user. In certain embodiments, those unreadable notes and/or unreadable negotiable instruments may be resubmitted by the user via a manual drop system, and the user may manually provide information regarding the denomination of the particular notes provided to the cash handling device 130 via the manual drop.

As is particularly relevant for deposits, the note acceptor may be configured to segregate notes by denomination prior to providing those notes to a note recycler and/or deposit cassette. The segregated notes may be stored in separate storage locations (e.g., separated portions of a recycler cassette and/or separated portions of a deposit cassette) such that the notes may be easily recycled based on denomination for later transactions if needed. In certain embodiments, the separate storage locations may comprise separate deposit cassettes, separate recycler cassettes, and/or separated portions of a deposit cassette and/or recycler cassette. As a specific example utilized with U.S. currency, a cash handling device 130 may comprise two cassettes (deposit cassettes, recycler cassettes, or both) configured for receiving and/or dispensing $1 bills, a third cassette (deposit, recycler, or both) configured for receiving and/or dispensing $5 bills, a fourth cassette (deposit, recycler, or both) configured for receiving and/or dispensing $20 bills, a fifth cassette (deposit, recycler, or both) divided into separate sections, a first section for receiving and/or dispensing $5 bills and a second section for receiving and/or dispensing $10 bills. A sixth cassette (deposit only) may be configured for receiving overflow of any denomination of note (including $1, $2, $5, $10, $20, $50, and $100) when a respective denomination-specific cassette is full and/or if no denomination specific cassette is provided for a particular note. For clarity, a cash handling device 130 may comprise deposit only cassettes having the above-referenced configuration, recycler only cassettes having the above-referenced configuration (except for the deposit-only overflow cassette) or may have two sets of cassettes having the above-referenced configuration (e.g., a first set of deposit cassettes having the above-referenced configuration and a second set of recycler cassettes having the above-referenced configuration, but without the overflow cassette). It should be understood that the configuration of specific denomination-specific cassettes mentioned above is presented as an example only, and any combination of denomination-specific cassettes may be utilized.

In certain embodiments, all notes received from the note acceptor during deposit transactions are first directed to a note recycler cassette for storage therein. Notes may be redirected from a recycler cassette to a deposit cassette to remove those notes from circulation upon the occurrence of one or more trigger events, such as a quantity of notes (e.g., a quantity of a given denomination of notes) exceeding a threshold quantity or upon receipt of user input requesting that notes are moved to the deposit cassette. As discussed herein, the trigger event utilized to redirect notes from a recycler cassette to a deposit cassette may be dynamic, and may be adjusted based at least on part on cash usage models established and/or maintained at the monitoring server. For example, on a first day, a first threshold quantity of notes may be utilized as a trigger event for redirecting funds to a deposit cassette, and on a second day, a second threshold quantity of notes, different from the first threshold quantity of notes, may be utilized as a trigger event for redirecting funds to a deposit cassette. Thus, the model maintained at the monitoring server may adjust the amount of cash available for circulation within a retail environment based at least in part on factors considered in maintaining the applicable model.

Moreover, as discussed herein, movement of notes to a deposit cassette may itself be a trigger event for various tasks to be performed by the cash handling device 130 or a networked monitoring system, such as transmitting data to a banking institution to direct funds into a particular account at the banking institution.

In certain embodiments, each time notes are moved within the cash handling device 130, the notes may pass through a quantity and/or denomination verification system to automatically monitor the amount of currency moving between the various portions of the cash handling device 130, thereby enabling the cash handling device 130 to maintain an accurate count of the amount of currency in each denomination contained therein.

With reference now to the coin circulation system, the cash handling device 130 may be comprise a coin acceptor configured to accept coins deposited by a user of the cash handling device 130 (e.g., accepting rolled coins and/or loose coins). The coin acceptor may have a rejection tray configured to return any unrecognizable coins deposited by the user. Moreover, the coin acceptor comprises a counting and/or verification system configured for counting the quantity and denomination of coins provided via the coin acceptor. Coins may then be passed to one or more coin recycle hoppers (e.g., which may comprise open trays, roll-creating hoppers, and/or the like) for storage within the cash handling device 130. In certain embodiments, those coin recycle hoppers may be configured for selectably dispensing coins as needed to fulfill a withdrawal request (e.g., as loose coins or as rolled coins). In such embodiments, the coins may be passed to one or more coin dispensing trays (e.g., coin roll dispensing trays or loose coin dispensing trays) for presentation to the user.

Like the note recyclers mentioned above, the cash handling device 130 may comprise a plurality of denomination specific coin hoppers for storage of deposited coins. For example, a cash handling device 130 may comprise two coin hoppers configured for storing $0.01 coins therein, another two coin hoppers configured for storing $0.05 coins therein, a fifth coin hopper configured for storing $0.10 coins therein, sixth and seventh coin hoppers configured for storing $0.25 coins therein, and an eighth, overflow coin hopper configured for storing coins of any denomination (such as $0.01, $0.05, $0.10, $0.25, $0.50, and $1). A cash handling device 130 may comprise deposit only coin hoppers having the above configuration, recycler coin hoppers having the above configuration, or both recycler coin hoppers and deposit coin hoppers having the above configuration. Moreover, the configuration of denominations of coin hoppers discussed herein is provided merely as an example, any combination of denomination-specific coin hoppers may be utilized.

Moreover, the cash handling device 130 may comprise a manual drop circulation system comprising a manual drop acceptor configured to accept notes and/or negotiable instruments provided by the user, and a manual drop storage cassette. The manual drop acceptor may operate in conjunction with the user interface, such that the manual drop may associate user-provided information regarding the quantity of a particular manual drop (e.g., value, quantity of a particular currency, and/or the like) with notes accepted via the manual drop. In certain embodiments, the manual drop cassette may be configured to separate each collection of notes accepted via the manual drop, such that the user-provided information regarding the quantity of currency provided via the manual drop may remain reflective of an amount of currency stored within a particular separated collection of notes. The manual drop may be a deposit only system, such that notes are not recycled to users from the manual drop cassette.

Although not shown, the cash handling device 130 may be configured for automatically providing cash into a cashier tray (also referred to herein as a retail till) (e.g., a tray to be utilized with a cash register at a POS terminal 140). In such embodiments, the cashier tray may be supported within the cash handling device 130, and the cash handling device 130 may selectably deposit quantities of notes and coins of select denominations into segmented portions of the cashier tray.

Moreover, the cash handling device 130 comprises a receipt printer configured for printing physical receipts that may be usable by individual users and/or during change order processing as discussed herein.

The cash handling device 130 may be configured such that at least a portion of the cash contained therein is bank-owned. This bank owned cash is not associated with any one or more customers' account(s), thereby enabling credits to be given to a user's account upon receiving a physical cash deposit at the cash handling device 130. Similarly, credit is not deducted from the user's account until and unless the user withdraws physical cash from the bank owned cash portion of the cash handling device 130.

In certain embodiments, the cash handling device 130 is configured such that only a portion of the total cash contained within the cash handling device 130 is bank-owned, and accordingly the cash handling device 130 defines a plurality of cash storage locations therein, including at least one storage location for bank owned cash and another storage location for customer (depositor) owned cash. As just one example, bank owned cash may be stored within a deposit cassette (which may not define an outlet for cash), while cash within a note recycler and/or a coin recycler (having both deposit and withdrawal configurations) may remain depositor owned. In certain embodiments, the cash handling device 130 comprises a verification mechanism for counting the quantity and value of notes being transferred into the deposit cassette or other storage location associated with bank-owned-cash. Accordingly, the cash handling device 130 is configured to utilize only verified funds that have been specifically counted and valued via the verification mechanism for bank-owned-cash.

In certain embodiments, the cash handling device 130 may be configured to enable deposits and withdrawals from bank owned cash portions by various users. Accordingly the bank owned cash portion of the cash handling device 130 may encompass at least a note recycler (and/or a coin recycler), and may additionally comprise a deposit cassette in certain embodiments.

Cash Handling Device Controller

A cash handling device 130 having the physical configuration discussed herein may have one or more onboard computing controllers configured for performing various functions and/or for controlling the functionality of various components of the cash handling device 130. In one embodiment, the cash handling device controller is embodied as a computing entity that may have a configuration similar to the mobile device 110 discussed above, and which may be configured to support processing in connection with deposit and withdrawal transactions for funds via the cash handling device 130. The one or more cash handling device controllers may include computing device(s) that are local to a corresponding cash handling device 130 and/or computing device(s) that are remotely located. At least one of the cash handling device controllers may be configured to access and store information/data in at least one of one or more datastores to perform processing supported by the cash handling device 130.

As just one example, the cash handling device controller may be configured to monitor the amount of each of a plurality of denominations of cash that are dispensed and/or collected during a deposit or withdrawal transaction. When dispensing cash into a retail till, the cash handling device controller may store a till identifier for which dispensing is performed, and may store data indicative of the amount of cash (and the denominations of those distributions) dispensed into the retail till. Additional metadata associated with the transaction may also be stored, such as the date and/or time of dispensing, a user identifier associated with the transaction, and/or the like. The cash handling device controller may provide the stored data of the transaction to the monitoring server (e.g., by transmitting the transaction-specific data via a network) for further processing. Similarly, when receiving cash deposited from a retail till, the cash handling device controller may store a till identifier for which dispensing is performed, and may store data indicative of the amount of cash (and the denominations of those deposits) deposited from the retail till. Additional metadata associated with the transaction may also be stored, such as the date and/or time of dispensing, a user identifier associated with the transaction, and/or the like. The cash handling device controller may provide the stored data of the transaction to the monitoring server (e.g., by transmitting the transaction-specific data via a network) for further processing.

Exemplary POS Terminal

A POS terminal 140 may be configured for receiving and/or dispensing cash during one or more transactions. A POS terminal 140 may be embodied as a self-checkout (SCO) terminal, specifically configured for operation with/by a retail customer. Particularly for POS terminals 140 configured for use in SCO implementations, the POS terminal 140 limits user access to cash stored therein, by accepting cash via a cash acceptor mechanism (e.g., an acceptor slot) and dispensing cash via a cash dispensing mechanism (e.g., a dispensing slot).

In other embodiments, a POS terminal 140 may be specifically configured for operation with/by a retail employee helping individual retail customers during transactions. The POS terminal 140 may comprise one or more user interfaces (e.g., an LCD monitor, a PIN-pad, and/or the like), one or more data readers (e.g., a card reader, a barcode reader, an NFC reader, a camera (which may also be utilized for recording security footage), a biometric reader, and/or the like). In certain embodiments, the cash handling device 130 hardware may comprise one or more secure information storage areas configured to securely store data, such as transaction data, cash content data, and/or the like.

The POS terminal 140 may further comprise one or more currency outputs (e.g., a coin dispenser, such as a loose coin dispenser, a note dispenser, such as loose note dispenser, and/or the like), one or more currency intakes (e.g., a coin acceptor, a check/note scanner/acceptor, and/or the like), a receipt printer, and/or the like. The POS terminal 140 may additionally comprise one or more cash recycler portions configured to store cash, separated by denomination, therein. The cash recycler portions may be configured to accept cash provided to the POS terminal 140 and/or to dispense cash from the POS terminal 140, for example, as change to a customer during a transaction. As discussed herein, the cash recycler portion may be configured as a Last-In-First-Out configuration for each denomination, such that the most recently received bill for a particular denomination is the first bill to be dispensed during the same or a later transaction.

The POS terminal 140 may comprise a note circulation system encompassing a note acceptor configured for providing notes to a user and/or for accepting notes deposited by a user. The note acceptor may be configured for processing a plurality of notes simultaneously (e.g., presented to the note acceptor in a stack) to speed transactions with the user. Notes passed between the note acceptor and one or more note recyclers may be counted, imaged, and/or otherwise verified to monitor the quantity of notes provided/withdrawn from the POS terminal 140, as well as the denomination of those notes.

As is particularly relevant for deposits, the note acceptor may be configured to segregate notes by denomination prior to providing those notes to a note recycler. The segregated notes may be stored in separate storage locations (e.g., separated portions of a recycler) such that the notes may be easily recycled based on denomination for later transactions if needed.

Moreover, the POS terminal 140 may comprise a POS terminal controller configured for causing the POS terminal 140 cash recycler to deposit and/or accept cash in applicable amounts for a particular transaction. In certain embodiments, the POS terminal controller may have a configuration similar to the cash handling device controller, such that the POS terminal controller comprises one or more non-transitory memory storage areas, one or more processors, one or more network connection mechanisms, and/or the like. Accordingly, the POS terminal controller may be in electronic communication (e.g., via a network) with the cash handling device controller, the monitoring server, and/or the like. Such network connections thereby enable the monitoring server to provide data directly to a POS terminal 140 (and vice versa), for example, so as to update data representative of an amount of BOC contained within the POS terminal 140, and/or to update data enabling the POS terminal 140 to distribute BOC during transactions.

Exemplary Networks

In one embodiment, any two or more of the illustrative components of the architecture of FIG. 1 may be configured to communicate with one another via respective communicative couplings to one or more networks 280. The networks 280 may include, but are not limited to, any one or a combination of different types of suitable communications networks such as, for example, cable networks, public networks (e.g., the Internet), private networks (e.g., frame-relay networks), wireless networks, cellular networks, telephone networks (e.g., a public switched telephone network), or any other suitable private and/or public networks. Further, the networks 280 may have any suitable communication range associated therewith and may include, for example, global networks (e.g., the Internet), metropolitan area networks (MANs), wide area networks (WANs), local area networks (LANs), or personal area networks. In addition, the networks 280 may include any type of medium over which network traffic may be carried including, but not limited to, coaxial cable, twisted-pair wire, optical fiber, a hybrid fiber coaxial (HFC) medium, microwave terrestrial transceivers, radio frequency communication mediums, satellite communication mediums, or any combination thereof, as well as a variety of network devices and computing platforms provided by network providers or other entities.

Transmissions over networks 280 may be "in the clear" or may leverage one of more of a variety of industry-standard or third-party security technologies implemented in any of the OSI layers used. If encryption is used, it may be symmetric or asymmetric (or implement a combination of the two, as in SSL/TLS, where the initial handshake uses asymmetric encryption in the exchange of symmetric keys, and subsequent transactions use symmetric encryption based on the previously exchanged symmetric keys). As will be recognized, process interaction over a network may be synchronous or asynchronous: synchronous-processes are coupled and include web services (e.g., SOAP), which may in turn leverage http(s); and various other remote procedure call (RPC), middleware protocols, industry-standard exchange formats (e.g., XML or JSON), and integration architectures (e.g., REST) and/or asynchronous-processes are decoupled and mechanisms include message queues and file transfers.

Exemplary System Operation

As indicated above, the monitoring servers are configured for maintaining data indicative of an amount of cash deemed BOC stored within one or more POS terminals 140 located at one or more retail locations. The monitoring servers may further provide data to each of the one or more POS terminals 140 to impact the functionality of those POS terminals 140 with respect to the quantity of BOC contained therein. For example, the monitoring servers may designate at least a portion of cash contained within one or more POS terminals 140 as BOC, such that data indicative of transactions involving BOC is passed to the monitoring server for updating corresponding BOC accounts (e.g., by transmitting data to respective financial institutions). In other embodiments, the monitoring servers may, via one or more data transmissions provided to the POS terminals 140, prevent (e.g., permanently or temporarily) the POS terminals 140 from distributing BOC during transactions. Similarly, the monitoring servers may be configured to convert customer-owned cash into BOC via data transmissions provided to the POS terminals 140, such that cash contained within the POS terminal 140 is treated as BOC for subsequent transactions.

As discussed herein, the monitoring server may be configured to communicate with one or more cash handling devices 130 and/or POS terminals 140 utilizing one or more communication protocols. Moreover, data received from the one or more cash handling devices 130 and/or POS terminals 140 may be encrypted utilizing one or more encryption protocols, and accordingly the monitoring server may be configured to appropriately decrypt data received from the cash handling devices 130 and/or POS terminals 140.

Figure 5:
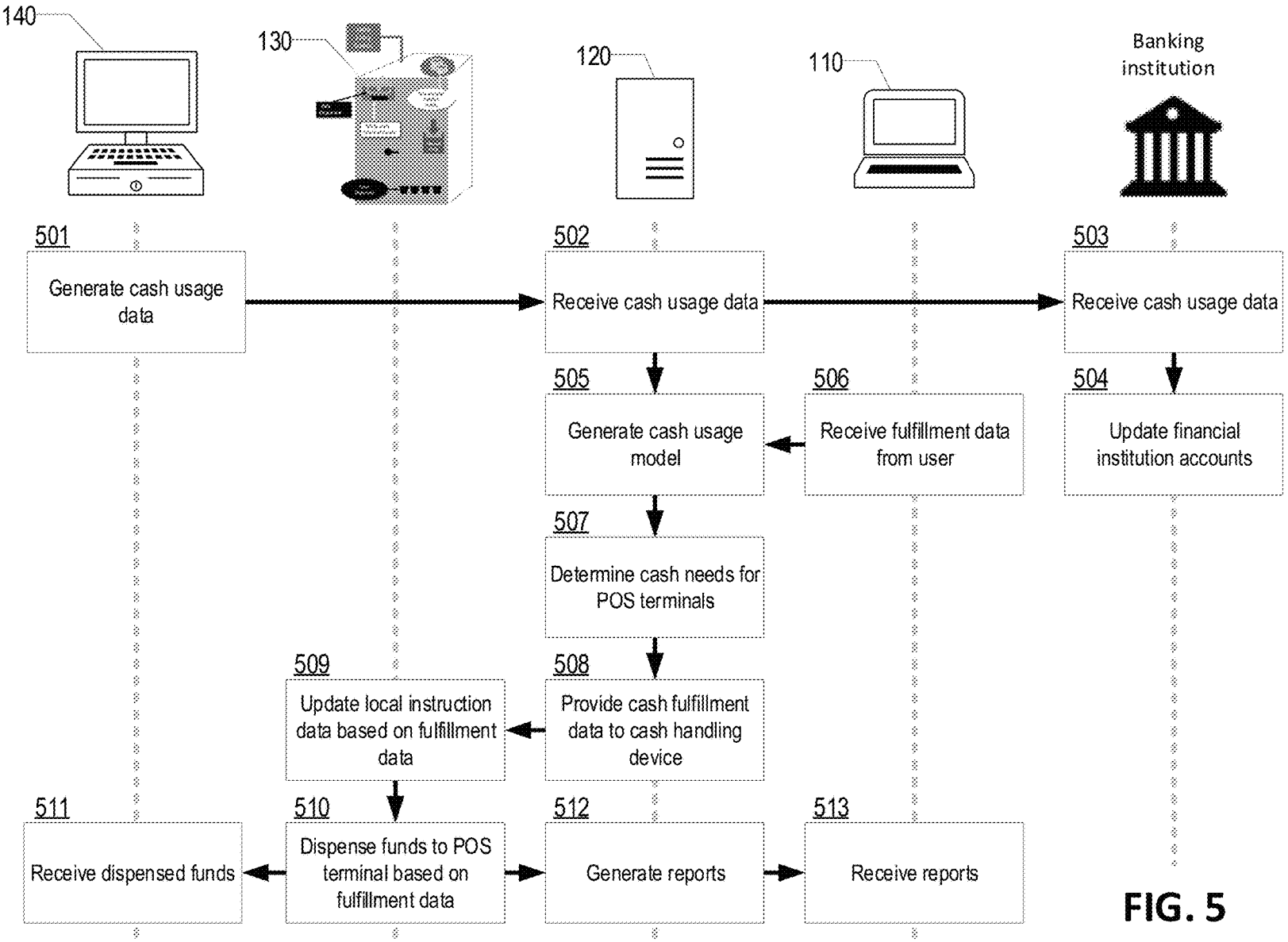
FIG. 5 is a flowchart illustrating various functions performed by computing entities of various embodiments.

FIG. 5 illustrates various steps performed by computing entities and/or hardware entities in accordance with various embodiments.

Cash Utilization Data Generation and Storage

Cash utilization data may be generated at one or more POS terminals 140 based at least in part on physical cash dispensed and/or received at the POS terminal 140. As mentioned above, during transactions in which cash is dispensed from the POS terminal 140 (e.g., to a customer during a retail transaction) and/or cash is deposited into the POS terminal 140 (e.g., from a customer during a retail transaction), the POS terminal 140 monitors the amount of cash involved in the particular transaction, as reflected at Block 501 of FIG. 5. The POS terminal 140 may monitor the amount of cash that is dispensed out of the POS terminal 140 and/or the amount of cash received into the POS terminal 140 via cash verification mechanisms (e.g., optical-based cash verification mechanisms within the POS terminal 140). In addition to monitoring the amount of cash within recycler portions of the POS terminal 140, the cash handling device 130 may utilize the transaction-specific data to monitor the difference in the amount of cash dispensed and the amount of cash received (e.g., during defined time periods). Based on the monitored activity of exchange transactions, the POS terminal 140 generates cash usage data reflecting local exchange transactions performed at the POS terminal 140.

The cash utilization data may comprise data indicative of a POS terminal 140 identifier associated with one or more particular transactions. An identifier associated with the transaction enables monitoring of cash usage associated with the particular POS terminal 140 over time. For example, utilizing a POS terminal 140 identifier, the amount of cash utilized (e.g., in the aggregate and/or at a denomination-specific level) during a particular time period (e.g., one business day) may be tracked and monitored over time, to monitor changes in the amount of cash usage associated with the particular POS terminal 140.

As a specific example, the cash utilization data generated at the POS terminal 140 may comprise transaction-specific data that may be reflected within transaction-specific data objects. Those transaction specific data objects may comprise a time-stamp corresponding with the transaction (e.g., a time-stamp assigned by the POS terminal 140 based at least in part on defined functionality of the POS terminal 140 to assign a time of execution of the transaction), a transaction type (e.g., cash, credit, check, and/or the like), a net amount of the transaction (e.g., the net amount of funds transferred to the merchant during the transaction), a funds-received amount (e.g., the gross amount of funds physically received at the POS terminal 140, reflecting an amount provided by the customer before providing change back to the customer for overpayment), a funds-dispensed amount (e.g., the gross amount of funds physically dispensed at the POS terminal 140, reflecting an amount of change or "cash-back" provided to the customer during the transaction), and/or the like. Additional metadata may be provided as a part of each transaction-specific data object, such as metadata indictive of an identity of merchant employee operating the POS terminal 140, identity of the POS terminal 140 itself, and/or the like. Such metadata may enable specific tracking of cash usage attributable to the particular POS terminal 140 and/or employee. In certain instances, particularly those in which the POS terminal 140 encompasses funds verification systems configured for individually identifying each cash-object received therein, the transaction-specific data object may comprise specific data indicative of the quantity of each denomination of cash received (and/or dispensed) during a particular transaction.

This cash utilization data is transmitted to the monitoring server, where the monitoring server may consolidate the cash utilization data and/or supplement the cash utilization data to provide cash utilization data over time for specific denomination of cash, for particular POS terminals 140, and/or the like. The monitoring server may extract data from a plurality of transaction data objects to generate time-series transaction data provided over time.

The cash utilization data comprises cash usage data for specific denominations of cash. For example, cash utilization of $20 bills may be monitored separately from cash utilization of $10 bills, $5 bills, and/or the like. Thus, the cash utilization of each of a plurality of cash denominations may be monitored separately. In addition to monitoring changes in cash amounts within the POS terminals 140 as a result of one or more transactions, the cash utilization data may additionally comprise data indicative of the total amount of cash (in the aggregate or at a denominational level) within the POS terminal 140. Moreover, the cash utilization data may additionally comprise data indicative of whether the cash (or what portion thereof) is considered BOC or customer-owned cash. However, as discussed in greater detail herein, the monitoring server may maintain data indicative of the identity of cash as BOC or customer-owned cash, as certain POS terminals 140 utilized in accordance with certain embodiments may be incapable of distinguishing therebetween.

In various embodiments, the cash utilization data additionally comprises data indicative of one or more cash management transactions, such as data indicative of advances and/or pick-ups from a POS terminal 140. The advances may be embodied as cash delivery transactions for providing additional cash to the POS terminal 140 (e.g., from the cash handling device 130), and may be identified as either "full" or "partial" advances, indicating that the POS terminal 140 required a full refill of cash or only a partial refill of cash. Similarly, pick-ups may be indicative of cash removed from the POS terminal 140, and can be identified as either "full" or "partial" advances, indicating that the POS terminal 140 required a pick-up of all funds therein or only a portion of the funds therein. Corresponding data objects indicative of these cash management transactions may comprise data indicative of a timestamp at which the transaction occurred, the type of transaction (e.g., advance or pick-up), the amount of cash involved (which may be identified at a denominational level), and/or the like. As discussed herein, cash utilization data indicative of cash management transactions may be treated separately from the remaining cash utilization data. In certain embodiments, the cash utilization data indicative of cash management transactions may be utilized as a metric to determine whether the POS terminal 140 cash amounts have been successfully optimized.

Cash utilization data may be transmitted to the monitoring server in real-time, periodically, and/or continuously. For example, upon generation of cash usage data for a particular transaction, the POS terminal 140 may be configured to transmit the data to the monitoring server in real time, and the monitoring server may receive the cash utilization data as indicated at Block 502. As another example, the POS terminal 140 may be configured to transmit the cash utilization data in a batch process at defined intervals (e.g., once per day, once per hour, and/or the like). If applicable, cash utilization data may be transmitted to a banking institution as well (either directly from the POS terminal 140 or by being relayed (with or without modification, as applicable) by the monitoring server. The banking institution may receive the cash utilization data, as shown at Block 503, and may update banking institution accounts, if necessary (as shown at Block 504). For example, banking institution accounts may be updated to reflect provisional cash deposits for a banking institution account, hard cash deposits, cash withdrawals, and/or the like, based on the exchange transactions performed at the cash handling device 130 and/or POS terminal 140.

The monitoring server receives the cash utilization data (as reflected by Block 502 of FIG. 5), and generates and/or updates one or more cash usage models as reflected at Block 505 (which may be based at least in part on user-provided fulfillment rules received as user input at computing entities 110 and provided to the monitoring server, as reflected at Block 506). The cash usage models may be utilized in determining an appropriate amount and/or mix of cash to be distributed to a particular POS terminal 140, as well as determining appropriate timing for distributing cash to the POS terminal 140.

The monitoring server stores the cash utilization data in one or more databases for use in generating and/or maintaining cash utilization models. In certain embodiments, the cash utilization data may be segregated within the storage databases (e.g., by utilizing physically separate database storage areas; by utilizing separate encryption mechanisms; and/or the like) based at least in part on associated entity identifiers or other identifiers to impede unauthorized access to data across entities/customers/etc.

Cash Usage Modelling

As reflected at Block 505 of FIG. 5, the monitoring server of certain embodiments is configured to generate and/or maintain one or more cash usage models for one or more POS terminals 140, one or more entities, one or more collections of POS terminals 140, and/or the like. The cash utilization models of certain embodiments utilize stored cash utilization data from one or more time periods (e.g., an immediately preceding time period for which cash utilization data was generated) and/or other data to determine optimal cash amounts and/or mixes (for each of a plurality of denominations) for distribution to one or more POS terminals 140 from an associated cash handling device 130. In certain embodiments, the cash utilization data for the one or more time periods may encompass cash utilization data objects having time stamps falling within the one or more time periods.

Moreover, as discussed in greater detail herein, the cash usage models may be utilized to determine an amount of cash stored within a POS terminal 140 to be designated as BOC. The cash usage models may be location specific, such that the models for cash usage are based solely on data generated at and/or with respect to a particular cash handling device 130 (and/or a defined plurality of POS terminals 140). In other embodiments, the cash usage models may be generated based at least in part on cash usage data generated at a plurality of cash handling devices 130, thereby enabling further analysis of correlations between particular location-specific circumstances and supplemental data (if applicable and considered).

The monitoring server may be configured to generate and/or maintain the one or more cash usage models using one or more user inputs, such as fulfillment rules/data, which may be provided by users accessing the monitoring server via a mobile device (or other computing entity), as reflected at Block 506. Accordingly, the monitoring server may be configured to generate and/or maintain one or more graphical user interfaces configured to provide users with data regarding the various cash usage models, and to receive user input regarding requested adjustments and/or other user-controlled factors for incorporation into the cash usage model. As just one example, user input may be provided to indicate a desired frequency of servicing one or more POS terminals 140 (e.g., to retrieve cash stored therein and/or to replenish cash stored therein) and/or desired quantities of cash to be stored within a POS terminal 140 (e.g., desired minimum amounts, desired maximum amounts, and/or the like). The monitoring server may generate a cash usage model designating amounts of cash to be indicated as BOC cash within one or more POS terminals 140, designating timing for servicing one or more POS terminals 140, designated timing for converting customer-owned cash to BOC within one or more POS terminals 140, and/or the like.

In certain embodiments, the user-controlled factors may comprise at least two interdependent factors, such that changing one of the interdependent factors results in a change to displayed values of another interdependent factor. The displayed values of the graphical user interface of the various user-controlled factors are reflected in generated cash usage models that influence operation of one or more cash handling devices 130 as discussed herein. In other embodiments, the user-controlled factors may comprise one or more independent factors, or a combination of interdependent and independent factors.

In certain embodiments, the cash usage models utilize the stored cash usage data—which is itself indicative of historical, actual cash usage by various POS terminals 140, to generate models of predicted cash usage at specific dates/times in the future. The cash usage models may generate dynamic cash usage predictions, updated as new cash usage data is provided to the monitoring server. For example, the cash usage models may generate predictions of cash usage for a future period of time (e.g., one week) and may update the predictions for each day as time progresses. Thus, predicted cash usage for April 1 may change (e.g., daily) between when an initial prediction is made on March 24 until a final prediction is made on March 31.

Based at least in part on the generated cash usage models, the monitoring server may be configured to provide real-time or near real-time feedback regarding the necessity of various cash management transactions occurring throughout a business day (and reflected within the cash utilization data). For example, the generated cash usage models may provide data regarding whether a particular pick-up or advance is necessary to service anticipated future customer-facing transactions at the POS terminals 140. Thus, by recognizing current real-time cash levels and comparing those against predicted POS usage, the monitoring server may be configured to designate cash management transactions identifiable within the cash utilization data as necessary to provide continued service to the POS terminal 140; unnecessary to provide continued service to the POS terminal 140; or partially necessary to provide continued service to the POS terminal 140. In certain embodiments, the monitoring server is configured to identify each cash management transaction as necessary, unnecessary, or partially necessary in real-time or near real-time upon receipt of cash utilization data reflecting the cash management transaction. The monitoring server may then be configured to generate one or more alerts to be provided to one or more user computing entities to provide a user interface element indicating the necessity of a recently performed cash management transaction. However, it should be understood that other embodiments may identify the necessity of cash management transactions in later-generated reports, with the necessity of each cash management transaction being indicated on the generated report.

In certain embodiments, predictions of cash usage may encompass only a portion of the cash usage models. The cash usage models may further provide data indicative of an optimal amount of cash to be distributed to one or more POS terminals 140, considering user-specified factors, such as a comfort level (e.g., the amount of cash in excess of a predicted usage that should be provided to a POS terminal 140), a confidence level (e.g., a level of assurance required by a user that the POS terminal 140 will not require additional cash, by denomination to satisfy requirements of customer-facing transactions), till capacity (e.g., data identifying physical characteristics of POS terminal 140 tills indicating the capacity thereof; the till capacity may be relevant for determining the amount of cash of a particular denomination that may be provided to the POS terminal 140 and/or for determining the amount of cash of a particular denomination that may be allowed to fill the POS terminal 140 as a result of customer-facing transactions), a POS terminal 140 minimum (e.g., indicative of a minimum amount of cash (e.g., on a denominational level) to be maintained within the POS terminal 140, this may override the comfort level and/or the determined optimized amount of cash to be provided to a POS terminal 140 in certain embodiments), weekday and/or weekend mixes (e.g., day-of-week-specified differences in cash denomination amounts and/or cash-denomination mixes to be provided to each POS terminal 140), timing of advances and/or pick-ups of cash to/from POS terminals 140, and/or the like. These user-specified factors may be defined for each POS terminal 140 individually, for a group of POS terminals 140 (e.g., having a common identifier within a POS terminal 140 profile), or all POS terminals 140. As just one example, a user associated with a first entity may provide user input indicating that no cash pick-ups and/or advances should be provided to POS terminals 140 during a business day. Such a user input may cause a corresponding change in the comfort level calculation, as a higher comfort level is required to ensure that POS terminals 140 maintain sufficient cash throughout a business day if no advances and/or pick-ups are to be performed. As another example, a user associated with a second customer may provide user input indicating that a lower comfort level is requested, corresponding with a desire to minimize the amount of cash out of a cash handling device 130 (and on a retail floor in one or more POS terminals 140) at any given time. Such a selection may cause a corresponding increase in the number of pick-ups and/or advances to be performed throughout a business day, such that the amount of cash within each POS terminal 140 remains sufficiently low to match the user's desired comfort level. In either event, based on the user-specified factors of comfort level and/or number of pick-ups and/or advances to be performed during a business day, the monitoring server may determine an optimal amount of cash to be distributed to each POS terminal 140 to satisfy the user's specified parameters based at least in part on the developed cash usage model for the locations, entities, users, retail tills, and/or the like. In embodiments in which a plurality of pick-ups and/or advances are scheduled to be performed throughout a business day, the monitoring server may determine the optimal amount of cash to be provided to each POS terminal 140 during each advance and/or pick-up scheduled during a business day.

In certain embodiments, the monitoring server may be configured to group POS terminals 140 associated with a particular retail establishment based at least in part on determined optimal cash amounts to be provided to those POS terminals 140. For example, POS terminals 140 associated with a particular retail establishment may be grouped into tiers based on the optimal amount of cash determined to be provided to the POS terminal 140. As specific example, the tiers may be established at uniform cash amounts (e.g., a first tier corresponds with POS terminals 140 assigned an optimal cash amount between $200-$300; a second tier corresponds with an optimal cash amount between $301-$400; a third tier corresponds with an optimal cash amount between $401-$500; and/or the like). POS terminals 140 included within each tier may thereafter be treated similarly (e.g., the amount of cash provided to each POS terminal 140 within a particular tier may be identical; cash management transactions may be scheduled together; and/or the like).

Controlling a POS Terminal

The monitoring server is configured to control the amount of cash stored within one or more POS terminals 140, and/or to control the classification of cash within each of one or more POS terminals 140 as BOC or customer-owned cash. As discussed herein, such classification of cash may impact accounting methods for how cash is allocated among accounts (e.g., whether the customer/retailer receives credit for the cash within the POS terminal 140). Moreover, the classification of cash within the POS terminal 140 may impact the functionality of the POS terminal 140 in receiving cash during a transaction and/or in distributing cash during a transaction. Accordingly, by changing the classification of cash within the POS terminals 140, the monitoring server is configured to control the operation of one or more POS terminals 140.

As an example reflected at Block 507 of FIG. 5, the monitoring server determines cash needs for one or more POS terminals 140, for example, based at least in part on the generated cash usage models. The cash needs may be reflected within cash fulfillment data indicative of the amount of cash to be distributed to one or more POS terminals 140 at a defined time. The cash fulfillment data is provided to a cash handling device 130 corresponding to the POS terminal 140, as reflected at Block 508, and the cash handling device 130 ingests the cash fulfillment data by updating locally stored instructions for distributing cash to a particular POS terminal 140, as reflected at Block 509. Thereafter, the cash handling device 130 is configured to dispense cash to the POS terminal 140 based on the locally stored instructions data that reflects the cash fulfillment data, as reflected at Block 510. The dispensed cash is received at the POS terminal 140, as reflected at Block 511, and the monitoring server may generate one or more reports, as reflected at Block 512 which may be distributed to one or more mobile devices, as reflected at Block 513.

As a part of generating a cash usage model and providing cash fulfillment data, the monitoring server may generate data designating at least a portion of cash within a POS terminal 140 as BOC. For example, the monitoring server may generate data designating a particular quantity of cash (e.g., in each denomination) as BOC. In other embodiments, the monitoring server may generate data designating cash within a particular location (e.g., a particular portion of a recycler, all cash within a deposit cassette, and/or the like) as BOC. In certain embodiments, the data designating cash as BOC may be transmitted to the POS terminal 140. In other embodiments, the data designating cash as BOC may be stored at the monitoring server, such that later-received data indicative of cash usage by the monitoring server may be correlated against the BOC designation data to determine whether cash used during one or more transactions was deemed customer-owned cash or BOC.

In certain embodiments, the monitoring server may be configured to designate all cash distributed to a POS terminal 140 as BOC, while any cash received during later transactions is deemed customer owned cash. Under such embodiments, BOC is only cash that has been independently verified (e.g., cash deemed BOC when entered into the cash handling device 130 which distributes cash to the POS terminal 140), and any cash that is not independently verified (e.g., cash received from a customer during a transaction) is not treated as BOC while stored within the POS terminal 140.

According to various embodiments, the monitoring server controls the operation of the POS in distributing cash during later transactions with customers. For example, the monitoring server may be configured to provide data to the POS such that BOC is not distributed from the POS during transactions. Such data may be provided as executable instructions (e.g., provided via an API or other data transmission mechanism) that are operable by the POS terminal 140 to insert instructions, rules, limitations, and/or the like into the software of the POS terminal 140 to impact the functionality of existing software and/or firmware of the POS terminal 140 such that the BOC is utilized during transactions in accordance with the instructions generated at the monitoring server. In other embodiments, the monitoring server may be configured to provide data to the POS such that transactions involving BOC are reported at a different frequency than transactions not involving BOC, and/or transactions involving BOC are reported to the monitoring server with different data types than transactions not involving BOC.

In certain embodiments, the monitoring server may be configured to convert customer-owned cash within a POS terminal 140 into BOC, for example, based on reports received at the monitoring server from the POS terminal 140 indicative of the quantity of funds stored therein. For example, at the end of a business day, the POS terminal 140 may provide a report of current contents of the POS terminal 140 to the monitoring server. The monitoring server may then provide data to a financial institution indicative of the amount of cash within the POS terminal 140, such that the financial institution is capable of crediting a customer-account with funds (e.g., provisional credits, hard credits, and/or the like), for example, from a bank-owned account at the financial institution, based on the amount of funds that have been converted from customer-owned cash to BOC within the one or more POS terminals 140, to convert the customer-owned cash into BOC. Upon receipt of confirmation from the financial institution, the monitoring server may thereafter treat all or a portion of the cash within the POS as BOC. In certain embodiments, the monitoring server may transmit data to the POS terminal 140 indicative of the conversion of cash from customer-owned cash to BOC. However, in other embodiments, the POS terminal 140 stores data indicative of the BOC locally, such that later data received from the POS is treated as BOC.

Operating One or More Accounting Methods at Multiple POS Terminals of a Retailer As discussed herein, the monitoring server is configured for enabling BOC accounting techniques to be applied to cash physically stored within a plurality of POS terminals 140 of a retail establishment, thereby enabling financial institution credits to be provided to a retailer's financial institution account for cash physically located within a POS terminal 140 inside of a retail establishment. In certain embodiments, the monitoring server may be configured to enable such accounting principles to be applied to each POS terminal 140 separately, or the monitoring server may be configured to consolidate cash usage data corresponding to a plurality of POS terminals 140 such that BOC accounting principles may be applied to cash stored within a plurality of POS terminals 140 as a consolidated group. In the latter embodiments, the financial institution may be provided with additional data indicative of the amount (and denomination) of cash stored within each individual POS terminal 140, for example, for audit purposes, thereby enabling the financial institution to determine whether each individual POS terminal 140 is operating appropriately.

As discussed herein, each POS terminal 140 may comprise network connectivity components enabling the POS terminal 140 to electronically communicate (e.g., via wired or wireless network connectivity) with one or more additional computing entities. For example, each POS terminal 140 may be configured to directly or indirectly communicate with the monitoring server. In certain embodiments, each POS terminal 140 may be configured to communicate with the Internet, thereby enabling the POS terminal 140 to communicate with computing entities external to the retailer's computing system. For example, in certain embodiments, the POS terminals 140 may be configured to communicate directly (or indirectly) with a financial institution to provide cash usage data to the financial institution. In such embodiments, each POS terminal 140 may store (e.g., in an encrypted form) data indicative of financial institution accounts, such that data provided from the POS terminal 140 to a financial institution is appropriately allocated to the appropriate merchant's financial account.

In other embodiments, the POS terminals 140 are configured to provide cash usage data to the monitoring server, which is configured to communicate with a financial institution (e.g., directly or indirectly) to provide appropriate cash usage data to the financial institution. In such embodiments, each POS terminal 140 need not comprise data indicative of specific financial institution accounts (or specific financial institutions generally), and instead the monitoring server may comprise data indicative of specific financial accounts, such that data from a particular POS terminal 140 may be attributed to a particular financial institution account. For example, upon receipt of cash usage data from a particular POS terminal 140, the monitoring server may utilize data within the cash usage data to attribute the cash usage data to a particular merchant (e.g., based at least in part on metadata associated with the cash usage data). The monitoring server may utilize the merchant-identifying data to identify data indicative of a particular financial institution associated with the merchant and/or a financial institution account associated with the merchant. As discussed herein, it should be understood that the monitoring server may be usable with a single financial institution. However, monitoring servers provided in accordance with certain embodiments may be usable with a plurality of financial institutions, and accordingly the monitoring server is configured to identify an appropriate financial institution and to identify appropriate communication protocols utilized to communicate with computing entities associated with the identified financial institution.

Moreover, for those embodiments in which the POS terminals 140 provide cash usage data to a monitoring server prior to the monitoring server providing the cash usage data to one or more financial institutions, the monitoring server may be configured to consolidate the cash usage data received from a plurality of POS terminals 140 (e.g., to generate a single data object comprising cash usage data attributable to a plurality of POS terminals 140). In certain embodiments, the cash usage data from a plurality of POS terminals 140 may be consolidated, such that a resulting data object comprises data indicative of POS terminal-specific usage data and an aggregate usage data of the plurality of POS terminals 140.

Regardless of how the cash usage data is provided to a financial institution, various embodiments may be configured for distinguishing between cash usage data generated by POS terminals 140 reliant on manual transaction amount verification (e.g., those POS terminals 140 operable by a merchant employee who counts cash provided by a customer and counts cash to be provided to a customer) and those POS terminals 140 utilizing automated cash amount verification systems (e.g., SCOs utilizing imaging devices configured for detecting/monitoring the amount of cash deposited/withdrawn from the SCO). In such embodiments, only cash usage data attributable to POS terminals 140 configured for automated detecting/monitoring of cash may be provided to a financial institution. Cash usage data for other POS terminals 140 may be provided to the financial institution after additional verification, such as verification processes that occur upon checking in the POS terminal 140 till to a CHD such that the CHD may execute automated quantity verification of funds within the till.

For those funds for which cash usage data is provided to a financial institution based on funds verification processes occurring at the POS terminals 140, the financial institution may apply credits to the merchant's financial institution account for funds stored within the POS terminals 140. In such embodiments, the monitoring server may be configured to maintain accounting data to be attributable to quantities of cash stored within individual POS terminals 140 (e.g., quantities of cash stored within SCO terminals), thereby providing data indicating whether the cash is customer-owned cash or bank-owned cash. As discussed herein, customer-owned cash can be considered funds that are withdrawn from the customer's financial institution accounts, while BOC is considered similarly to funds that are maintained within a financial institution account. Because the cash within the SCOs are verified (a financial institution can verify the functionality of the cash verification mechanisms of individual POS terminals 140 prior to accepting cash stored therein as BOC), the cash stored within the POS terminal 140 may be attributable to the retailer's financial institution account. Thus, withdrawals of funds from the POS terminal 140 (e.g., during a transaction) may be debited against the retailer's financial institution account, and deposits of funds to the POS terminal 140 (e.g., during a transaction) may be credited against the retailer's financial institution account (e.g., after verification of the funds provided to the POS terminal 140).

In certain embodiments, only a subset of a retailer's POS terminals 140 are eligible for BOC accounting treatment. As mentioned above, only those terminals providing automated verification of funds may be eligible for BOC accounting treatment. Moreover, a financial institution may require independent verification of the functionality of the automated funds verification mechanisms of each individual POS terminal 140 prior to permitting BOC accounting treatment. The financial institutions may additionally require periodic recertification of the functionality of the cash verification mechanisms to maintain applicability of BOC accounting treatment. Accordingly, each POS terminal 140 have a corresponding POS terminal 140 profile stored and/or maintained at the monitoring server and/or at a financial institution. The POS terminal 140 profile may comprise identification data of the POS terminal 140 (e.g., a POS terminal 140 unique identifier, data indicative of the location of the POS terminal 140, data indicative of a POS terminal 140 type, and/or the like), as well as a BOC approval indicator embodied as a binary indictor identifying whether the POS terminal 140 is approved for BOC accounting treatment. In various embodiments, the POS terminal 140 profile may additionally comprise a BOC eligibility indicator which simply indicates whether the POS terminal 140 is of a type that is eligible for review and approval for BOC accounting treatment. In applicable embodiments, the BOC eligibility indicator may not change for a particular POS terminal 140, however the BOC approval may be modified based on whether a financial institution representative has approved the POS terminal 140 for BOC accounting treatment. As noted, the POS terminal 140 profile may be stored at the monitoring server in some embodiments, and accordingly data indicative of whether the POS terminal 140 has been approved for BOC accounting treatment may be provided (e.g., from a financial institution computing entity, from a user computing entity associated with a banking institution representative, and/or the like). In such embodiments, the monitoring server may be configured to compile data indicative of cash usage data for those POS terminals 140 having a corresponding BOC approval indicator identifying those POS terminals 140 as being approved for BOC accounting treatment. Thus, only cash usage data corresponding to the BOC-approved POS terminals 140 is provided to the financial institution for BOC accounting treatment.

In other embodiments, the financial institution may maintain a POS terminal 140 profile for each POS terminal 140, and thus the financial institution may independently monitor those POS terminals 140 for which BOC accounting treatment is approved. Thus, the monitoring server may provide cash usage data for all POS terminals 140 (or a subset of all POS terminals 140, such as those POS terminals 140 deemed eligible for BOC accounting treatment, regardless of approval status), and the financial institution may parse the received cash usage data to determine which POS terminals 140 should be treated under BOC accounting treatment. In such embodiments, the financial institution may provide a response data packet to the monitoring server indicating which POS terminals 140 have been afforded BOC accounting treatment, thereby enabling the monitoring server to provide updated accounting data to a user, indicative of whether each POS terminal 140 is operating under BOC accounting or customer-owned accounting (or both), such that a user maintains appropriate information regarding the accounting treatment of funds within various POS terminals 140.

In certain embodiments, the monitoring server may be configured to apply BOC accounting treatment to cash stored within particular POS terminals 140 upon transmitting a cash usage data object to the financial institution. Accordingly, the monitoring server may not require a confirmation from the financial institution prior to implementing BOC accounting treatment for funds within a POS terminal 140. However, until funds associated with a particular transaction have been represented within a cash usage data object transmitted to the financial institution, the funds (whether deposited or withdrawn funds) may not be applied against the BOC cash accounting of the POS terminal 140.

In other embodiments, the monitoring server may await the receipt of a confirmation from the financial institution of receipt and approval of the cash usage data object prior to applying BOC accounting treatment of funds represented within the cash usage data object. Upon receipt of a confirmation data object from the financial institution computing entity, the monitoring server is configured to update cash usage data stored in association with the monitoring server to reflect that cash stored within one or more POS terminals 140 is considered BOC cash.

As discussed herein, cash usage data may be provided to a financial institution on a continuous basis (e.g., after execution of a transaction) or in a batch process (e.g., at specified times). Thus, a POS terminal 140 may be configured for storing cash subject to a plurality of accounting treatments simultaneously (e.g., in an interim period between execution of a transaction and receiving confirmation from a financial institution that cash involved in a particular transaction has been afforded BOC accounting treatment), while other cash stored within the POS terminal 140 has previously been afforded BOC accounting treatment. At least during the period of time in which cash subject to multiple accounting principles is stored within the POS terminal 140, the monitoring server may be configured to maintain an updatable ledger of cash subject to each accounting treatment, wherein the updatable ledger provides denomination-specific indications of the amount of cash subject to each accounting treatment within the POS terminal 140. The updatable ledger may be updated by the monitoring server upon confirming that at least a portion of the cash stored within the POS terminal 140 has changed accounting treatment (e.g., from customer-owned cash to BOC or vice versa). Moreover, as a plurality of transactions may occur while the POS terminal 140 is storing cash subject multiple accounting treatments, the monitoring server may be configured to apply one or more rules to subsequent deposits/withdrawals of cash in subsequent transactions occurring while the POS terminal 140 stores cash subject to multiple accounting treatments. For example, the monitoring server may be configured to apply a rule that, while a POS terminal 140 is storing customer-owned cash, that customer-owned cash should be withdrawn (e.g., in subsequent transactions) before any BOC is withdrawn. As yet another example, the monitoring server may be configured to apply a rule that, while a POS terminal 140 is storing customer-owned cash and BOC, the BOC should be withdrawn (e.g., in subsequent transactions) before any customer-owned cash is withdrawn. It should be understood that other rules may be implemented by certain embodiments to cash received/dispensed during subsequent transactions occurring during a period of time in which the POS terminal 140 stores cash subject to customer-owned cash accounting treatments and BOC accounting treatments.

Moreover, the monitoring server may be configured to utilize differing cash accounting treatments for various transaction types involving a POS terminal 140. For example, customer-facing transactions may result in customer-owned cash being added to the POS terminal 140, while cash management transactions (e.g., movement of cash into the POS terminal 140) may be configured to add bank-owned cash to the POS terminal 140, if the source of the funds to be added to the POS terminal 140 was also subject to BOC accounting treatment. For example, movement of bank-owned funds from a CHD to the POS terminal 140 may result in no change to the accounting treatment of the funds as the funds are physically moved from the CHD to the POS terminal 140. In such embodiments, BOC funds added to the POS terminal 140 may be reflected as additions of BOC funds within a ledger corresponding to the POS terminal 140.

CONCLUSION

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A Point-of-Sale (POS) terminal cash till management computing system for managing cash physically located within a plurality of POS terminals, the computing system comprising:

one or more non-transitory memory storage areas, wherein the one or more non-transitory memory storage areas store a cash ledger for each of a plurality of POS terminals, wherein the cash ledger defines at least two accounting treatments for cash physically stored within a POS terminal, wherein the at least two accounting treatments comprises a first accounting treatment and a second accounting treatment; and one or more processors collectively configured to:

receive one or more cash utilization data objects indicative of one or more cash transactions occurring at the plurality of POS terminals, wherein each of the one or more cash utilization data objects comprises data identifying an accounting treatment corresponding with the cash transaction;

generate a message corresponding to one or more cash transactions identified as the first accounting treatment;

transmit the message corresponding to the one or more cash transactions identified as the first accounting treatment to an external financial institution computing entity to enable execution of financial transactions associated with a financial account at the external financial institution;

update the cash ledger stored for each of the plurality of POS terminals to reflect a change in cash quantity within at least one of the plurality of POS terminals and wherein the change in cash quantity is reflected within a change in cash quantity associated with the accounting treatment corresponding with the cash transaction of the at least two accounting treatments;

update the cash ledger stored for at least one of the plurality of POS terminals to reflect a change in accounting treatment for a quantity of cash from the first accounting treatment to the second accounting treatment;

generate a message comprising data identifying the change in accounting treatment for the quantity of cash; and transmit the message comprising data identifying the change in accounting treatment for the quantity of cash to an external financial institution computing entity to enable execution of financial transactions associated with a financial account at the external financial institution.

2. The POS terminal cash till management computing system of claim 1, wherein the accounting treatment corresponding with the cash transaction is a Bank-Owned Cash (BOC) accounting treatment, and wherein transmitting the message corresponding to the one or more cash transactions to the external financial institution computing entity causes execution of a financial transaction to change an amount of funds within the financial account, wherein the financial account is associated with an entity managing the plurality of POS terminals.

3. The POS terminal cash till management computing system of claim 1, wherein updating the cash ledger comprises updating data indicating a quantity of cash stored within the POS terminal and subject to the accounting treatment corresponding with the cash transaction, at a cash denominational level.

4. The POS terminal cash till management computing system of claim 1, wherein the one or more cash utilization data objects comprises data indicating the at least two accounting treatments correspond with the cash transaction and indicating a quantity of cash associated with each of the at least two accounting treatments.

5. The POS terminal cash till management computing system of claim 4, wherein:

generating a message corresponding to one or more cash transactions identified as the first accounting treatment comprises generating a message identifying a first quantity of cash associated with the one or more cash transactions subject to the first accounting treatment; and updating the cash ledger comprises updating the cash ledger to reflect a change in cash quantity within at least one of the plurality of POS terminals subject to each of the at least two accounting treatments.

6. The POS terminal cash till management computing system of claim 1, wherein the one or more processors are further configured to:

transmit data to the POS terminal based at least in part on the change in accounting treatment for a quantity of cash from the first accounting treatment to the second accounting treatment to cause the POS terminal to move the quantity of cash from a first storage location corresponding with the first accounting treatment to a second storage location corresponding with the second accounting treatment.

7. A computer-implemented method for managing cash physically located within a plurality of Point-of-Sale (POS) terminals, the method comprising:

storing, within one or more non-transitory memory storage areas, a cash ledger for each of a plurality of POS terminals, wherein the cash ledger defines at least two accounting treatments for cash physically stored within a POS terminal, wherein the at least two accounting treatments comprises a first accounting treatment and a second accounting treatment;

receiving, via one or more processors, one or more cash utilization data objects indicative of one or more cash transactions occurring at the plurality of POS terminals, wherein each of the one or more cash utilization data objects comprises data identifying an accounting treatment corresponding with the cash transaction;

generating, via the one or more processors, a message corresponding to one or more cash transactions identified as the first accounting treatment;

transmitting, via the one or more processors, the message corresponding to the one or more cash transactions identified as the first accounting treatment to an external financial institution computing entity to enable execution of financial transactions associated with a financial account at the external financial institution;

updating, via the one or more processors, the cash ledger stored for each of the plurality of POS terminals to reflect a change in cash quantity within at least one of the plurality of POS terminals and wherein the change in cash quantity is reflected within a change in cash quantity associated with the accounting treatment corresponding with the cash transaction of the at least two accounting treatments;

updating, via the one or more processors, the cash ledger stored for at least one of the plurality of POS terminals to reflect a change in accounting treatment for a quantity of cash from the first accounting treatment to the second accounting treatment;

generating, via the one or more processors, a message comprising data identifying the change in accounting treatment for the quantity of cash; and transmitting, via the one or more processors, the message comprising data identifying the change in accounting treatment for the quantity of cash to an external financial institution computing entity to enable execution of financial transactions associated with a financial account at the external financial institution.

8. The computer-implemented method for managing cash physically located within the plurality of POS terminals of claim 7, wherein the accounting treatment corresponding with the cash transaction is a Bank-Owned Cash (BOC) accounting treatment, and wherein transmitting the message corresponding to the one or more cash transactions to the external financial institution computing entity causes execution of a financial transaction to change an amount of funds within the financial account, wherein the financial account is associated with an entity managing the plurality of POS terminals.

9. The computer-implemented method for managing cash physically located within the plurality of POS terminals of claim 7, wherein updating the cash ledger comprises updating data indicating a quantity of cash stored within the POS terminal and subject to the accounting treatment corresponding with the cash transaction, at a cash denominational level.

10. The computer-implemented method for managing cash physically located within the plurality of POS terminals of claim 7, wherein the one or more cash utilization data objects comprises data indicating the at least two accounting treatments correspond with the cash transaction and indicating a quantity of cash associated with each of the at least two accounting treatments.

11. The computer-implemented method for managing cash physically located within the plurality of POS terminals of claim 10, wherein:

generating a message corresponding to one or more cash transactions identified as the first accounting treatment comprises generating a message identifying a first quantity of cash associated with the one or more cash transactions subject to the first accounting treatment; and updating the cash ledger comprises updating the cash ledger to reflect a change in cash quantity within at least one of the plurality of POS terminals subject to each of the at least two accounting treatments.

12. The computer-implemented method for managing cash physically located within the plurality of POS terminals of claim 7, further comprising:

transmitting data to the POS terminal based at least in part on the change in accounting treatment for a quantity of cash from the first accounting treatment to the second accounting treatment to cause the POS terminal to move the quantity of cash from a first storage location corresponding with the first accounting treatment to a second storage location corresponding with the second accounting treatment.

13. A computer program product comprising a non-transitory computer readable medium having computer program instructions stored therein, the computer program instructions when executed by a processor, cause the processor to:

store, within one or more non-transitory memory storage areas, a cash ledger for each of a plurality of POS terminals, wherein the cash ledger defines at least two accounting treatments for cash physically stored within a POS terminal, wherein the at least two accounting treatments comprises a first accounting treatment and a second accounting treatment;

receive one or more cash utilization data objects indicative of one or more cash transactions occurring at the plurality of POS terminals, wherein each of the one or more cash utilization data objects comprises data identifying an accounting treatment corresponding with the cash transaction;

generate a message corresponding to one or more cash transactions identified as the first accounting treatment;

transmit, via the one or more processors, the message corresponding to the one or more cash transactions identified as the first accounting treatment to an external financial institution computing entity to enable execution of financial transactions associated with a financial account at the external financial institution;

update the cash ledger stored for each of the plurality of POS terminals to reflect a change in cash quantity within at least one of the plurality of POS terminals and wherein the change in cash quantity is reflected within a change in cash quantity associated with the accounting treatment corresponding with the cash transaction of the at least two accounting treatments;

update the cash ledger stored for at least one of the plurality of POS terminals to reflect a change in accounting treatment for a quantity of cash from the first accounting treatment to the second accounting treatment;

generate a message comprising data identifying the change in accounting treatment for the quantity of cash; and transmit the message comprising data identifying the change in accounting treatment for the quantity of cash to an external financial institution computing entity to enable execution of financial transactions associated with a financial account at the external financial institution.

14. The computer program product of claim 13, wherein the accounting treatment corresponding with the cash transaction is a Bank-Owned Cash (BOC) accounting treatment, and wherein transmitting the message corresponding to the one or more cash transactions to the external financial institution computing entity causes execution of a financial transaction to change an amount of funds within the financial account, wherein the financial account is associated with an entity managing the plurality of POS terminals.

15. The computer program product of claim 13, wherein updating the cash ledger comprises updating data indicating a quantity of cash stored within the POS terminal and subject to the accounting treatment corresponding with the cash transaction, at a cash denominational level.

16. The computer program product of claim 13, wherein the one or more cash utilization data objects comprises data indicating the at least two accounting treatments correspond with the cash transaction and indicating a quantity of cash associated with each of the at least two accounting treatments.

17. The computer program product of claim 16, wherein:

generating a message corresponding to one or more cash transactions identified as the first accounting treatment comprises generating a message identifying a first quantity of cash associated with the one or more cash transactions subject to the first accounting treatment; and updating the cash ledger comprises updating the cash ledger to reflect a change in cash quantity within at least one of the plurality of POS terminals subject to each of the at least two accounting treatments.

* * * * *